US008534655B2

(12) United States Patent
Hovarter

(10) Patent No.: US 8,534,655 B2
(45) Date of Patent: Sep. 17, 2013

(54) QUICK ACTION WOODWORKING VISE

(76) Inventor: Len Alan Hovarter, Howell, MI (US)

( * ) Notice: Subject to any disclaimer, the term of this patent is extended or adjusted under 35 U.S.C. 154(b) by 250 days.

(21) Appl. No.: 13/110,984

(22) Filed: May 19, 2011

(65) Prior Publication Data

US 2011/0285070 A1 Nov. 24, 2011

Related U.S. Application Data

(60) Provisional application No. 61/396,221, filed on May 24, 2010.

(51) Int. Cl.
*B25B 1/02* (2006.01)
*B25B 1/06* (2006.01)

(52) U.S. Cl.
USPC ..... 269/167; 269/196; 269/169; 269/170

(58) Field of Classification Search
USPC ..... 269/200, 205, 169, 196, 198, 202, 269/203, 204, 234, 217, 167, 43, 45, 156, 269/152, 157, 136–140; 29/559
See application file for complete search history.

(56) References Cited

U.S. PATENT DOCUMENTS

| | | | | |
|---|---|---|---|---|
| 142,470 | A | 9/1873 | Hunt | |
| 207,349 | A | 8/1878 | Dutton | |
| 259,351 | A | 6/1882 | Ayer | |
| 570,340 | A | 10/1896 | Sabourin | |
| 613,535 | A | 11/1898 | Toles | |
| 663,145 | A | 12/1900 | Zwart | |
| 681,826 | A | 9/1901 | Howard | |
| 720,895 | A * | 2/1903 | Cook | 269/212 |
| 816,508 | A | 3/1906 | Snow | |
| 825,151 | A | 7/1906 | McLean | |
| 831,919 | A | 9/1906 | Abernathy | |
| 866,296 | A | 9/1907 | McIntyre | |
| 1,283,192 | A | 10/1918 | Hughes | |
| 1,407,743 | A | 2/1922 | Franck | |
| 1,439,822 | A | 12/1922 | Johnson | |
| 2,362,067 | A * | 11/1944 | Heinrich | 269/168 |
| 2,398,941 | A | 4/1946 | Jordan | |
| 2,415,303 | A * | 2/1947 | Moore | 269/167 |

(Continued)

*Primary Examiner* — Lee D Wilson
*Assistant Examiner* — Tyrone V Hall, Jr.
(74) *Attorney, Agent, or Firm* — Endurance Law Group, PLC

(57) ABSTRACT

A quick-release vise utilizing one or more clamp shafts that can be easily re-configured to clamp with CW or CCW rotation of a clamp handle. The clamp shaft is received in a housing secured to the underside of a workbench, and is free to slide in and out. The clamp shaft passes through aligned holes in a pair of opposing jaws, at least one of which is moveable. A pinion freely slides on the clamp shaft within the housing and converts rotational movement from the clamp shaft into linear movement via a meshing rack gear. The linear motion actuates a bridge which slides against a laterally fixed wedge causing the bridge to displace a locking element which clutches and moves the clamp shaft to affect clamping between the jaws. The wedge and bridge pair can be inverted to allow clamping to occur with a either CW or CCW rotation of the clamp handle and/or re-oriented to cause a spreading motion between the jaws rather than a clamping motion. The linear motion from the clamp shaft may be transferred to a second, parallel clamp shaft through a transfer bar in certain twin-shaft embodiments. In certain twin-shaft applications, one of the housings may be rotated 180° relative to the other to provide outward clamping force on one clamp shaft and inward clamping force on the other clamp shaft.

17 Claims, 23 Drawing Sheets

(56) References Cited

U.S. PATENT DOCUMENTS

| | | | | |
|---|---|---|---|---|
| 2,456,183 | A | 12/1948 | Green | |
| 2,550,547 | A | 4/1951 | Follmer et al. | |
| 2,704,478 | A | 3/1955 | Webb | |
| 3,147,003 | A | 9/1964 | Johnson | |
| 3,669,440 | A | 6/1972 | Kartasuk et al. | |
| 3,850,422 | A | 11/1974 | Kwas | |
| 4,057,239 | A | 11/1977 | Hopf et al. | |
| 4,262,892 | A | 4/1981 | Wu | |
| 5,127,639 | A * | 7/1992 | Tucker et al. | 269/139 |
| 6,761,349 | B2 | 7/2004 | McCraw | |

* cited by examiner

QUICK ACTION WOODWORKING VISE

CROSS REFERENCE TO RELATED APPLICATIONS

This application claims priority to Provisional Patent Application No. 61/396,221, filed May 24, 2010, the entire disclosure of which is hereby incorporated by reference and relied upon.

BACKGROUND OF THE INVENTION

1. Field of the Invention

A work holder including two or more jaws movable with respect to each other, and more particularly a screw-less, quick-action vise assembly.

2. Related Art

Woodworking workbenches have traditionally employed a vise or vises for gripping workpieces. The vises utilized have taken many different forms which suit a wide array of woodworking tasks. Face vises, mounted on the front or long face of the workbench may be in the form of a twin screw face vise with the screws coupled by a chain or where the screws are independent. They also take the form of cast iron Emmert style vises which have pivoting jaws to accept tapered or irregular shaped work or the quick action Record style of vise which typically have a central screw combined with two laterally displaced guide rods. Another form of face vise is the leg vise which utilizes a screw mounted in one of the workbench legs with a vertically displaced fulcrum arm which accepts a peg installed in a hole to match the thickness of the work being secured. Face vises may also be in the form of the Scandinavian style shoulder vise which has a vise screw installed in a bench block mounted at the end of the bench and typically supported by an additional leg. The vise jaw is open to three sides so it has the ability to clamp work that would be difficult to clamp in the other style of vises.

Vises may also be found mounted to the end of the bench in the form of a tail vise. Typically the tail vise includes a dog which may be used to clamp work flat on the bench top between a corresponding bench dog mounted in various holes in the top of the bench. Many of the previously described face vises may be mounted on the end of the bench to function as a tail vise. The twin screw vise for example may be mounted on the end of the bench and be the same width as the bench top. If provisions are made in the vise jaw to accept bench dogs then the vise can function as a tail vise and still operate as a face vise mounted in the end or tail vise position.

All of the aforementioned vises excel at some tasks and have deficiencies which have to be overcome. Twin screw vises offer drop through clamping of large objects without racking since pressure is applied on both sides of the workpiece. The chain operated twin screw vise may have an external chain which detracts from the aesthetics of the work bench. The chain operated twin screw vises do not have quick action and have to be laboriously cranked in and out. The screws also require grease to work freely which may soil the workpiece if contacted. Independent operated twin screw vises also do not have quick action and require each screw to be operated while maintaining a grasp on the workpiece with the operators other hand. The iron style face vises may have quick action and are easy to install but the central screw and guide rods prevent drop through clamping. The vise jaws may rack if the work is not centered and the quick action nut may clog with dirt and sawdust preventing proper action. Some vises require the actuation of a lever to enable quick action which makes them difficult to operate and the screw requires grease which may soil the workpiece. Leg vises excel at clamping work to the front face of the bench and have great holding power due to the long fulcrum arm. They do not have quick action and a peg must be moved in the fulcrum arm each time a different thickness workpiece is clamped. The fulcrum arm is very near the floor and requires considerable bending to change. The Scandinavian style shoulder vise requires the vise to be designed into the bench since it requires an additional leg. They do not have quick action and the bench block and vise screw extending outward from the front of the bench can be awkward to move around. Traditional tail vises are aesthetically pleasing and work well but they are very difficult to install, do not have rapid action and may sag when extended.

Typically, all screw actuated vises operate with clockwise rotation of the clamp handle which ergonomically speaking may not be ideal for all operators. Left-handed people in particular may find that clockwise operation is not the best direction of rotation for them.

Screw-less, or so-called clutch-type, vises have been proposed as alternatives to the aforementioned traditional screw-type vise. Screw-less vises are, by nature, quick-acting in that the vise jaws can be quickly opened and closed with a pushing or pulling force on the vise handle. These type of vises commonly utilize one or more clutch plates that smoothly slide along an elongated clamp shaft when held in a perpendicular orientation. Partial rotation of the vise handle turns a helical ramp that is positioned to interact with the clutch plate. Relative movement between the helical ramp and clutch plate causes the clutch plate to tip away from perpendicular and grip the clamp shaft. Continued rotation of the vise handle then draws the vise jaws together into engagement with a work piece. Examples of screw-less vises may be seen in U.S. Pat. Nos. 831,919 to Abernathy, 1,283,192 to Hughes, 1,439,822 to Johnson, 2,415,303 to Moore, and 4,057,239 to Hopf et al. In all of these examples, the clutch plate is fashioned as a non-circular member constrained to a particular orientation relative to the shaft. As a result, the clutch plate and shaft do not rotate relative to one another, thus causing the clutch and/or shaft to wear unevenly over time. Furthermore, the helical ramp feature common to the prior art screw-less vises is relatively expensive to manufacture, limits the clamping direction to a single direction (typically CW), and makes the vise assembly relatively unsuitable for use in multi-shaft, i.e., ganged, scenarios found in many woodworking vise applications.

SUMMARY OF THE INVENTION

According to a first aspect of this invention, a screw-less vise assembly is provided of the type for clamping a workpiece between opposing jaws. The assembly comprises a housing and a pair of jaws. At least one of the jaws is moveable relative to the housing and moveable relative to the other the jaw. An elongated clamp shaft defined a long axis and is slideably carried by the moveable jaw and the housing. The clamp shaft includes a clamp hub that is engagable with the moveable jaw. A locking element is supported by the housing and has a generally planar body. The locking element includes also a central hole in the body through which the clamp shaft slideably extends. A wedge is supported relative to the housing. A bridge is operatively disposed between the wedge and the locking element for reciprocating linear movement in a plane generally parallel to and offset from the axis of the clamp shaft in response to rotation of the clamp shaft. The bridge is configured to angularly displace the locking element into canted frictional engagement with the clamp shaft and then, with continued rotation of the clamp shaft, to axially displace the clamp shaft thereby forcibly drawing the moveable jaw toward the housing and the other the jaw.

The reciprocating linear bridge of this invention provides several advantages over prior art designs that lead to a more robust, more easily manufactured, and more versatile vise assembly.

According to another aspect of this invention, a twin shaft vise assembly if provided for clamping a workpiece between opposing jaws. The assembly comprises a pair of jaws and first and second clamping sub-assemblies. At least one of the jaws is moveable relative to the other the jaw. The first clamping sub-assembly comprises a first housing and an elongated first clamp shaft defining a long axis. The first clamp shaft is slideably carried by the moveable jaw and the first housing. A first locking element is supported by the housing. The first locking element has a generally planar body and a central hole in the body through which the first clamp shaft slideably extends. A first wedge is supported relative to the first housing. A first bridge is operatively disposed between the first wedge and the first locking element for reciprocating linear movement in a plane generally parallel to and offset from the axis of the first clamp shaft in response to rotation of the first clamp shaft. The first bridge is configured to angularly displace the first locking element into canted frictional engagement with the first clamp shaft and then, with continued rotation of the first clamp shaft, to axially displace the first clamp shaft thereby forcibly drawing the moveable jaw toward the other the jaw. The second clamping sub-assembly comprises a second housing and an elongated second clamp shaft defining a long axis. The second clamp shaft is supported parallel to the first clamp shaft. A second locking element is provided having a generally planar body and a central hole in the body through which the second clamp shaft slideably extends. A second wedge is supported relative to the second housing. A second bridge is operatively disposed between the second wedge and the second locking element for reciprocating linear movement. A motion transmitting member interconnects the first bridge and the second bridge for simultaneously displacing the first bridge and the second bridge in response to rotation of at least one of the first and second clamp shafts.

According to a still further aspect of this invention, a method is provided for clamping a workpiece between opposable jaws in a screw-less vise assembly. The method comprises the steps of providing a pair of jaws, at least one of the jaws being moveable relative to the other the jaw, and slideably and rotatably supporting an elongated clamp shaft through the moveable jaw. A locking element is slideably supported on the clamp shaft. A wedge is provided. A bridge is located between the wedge and the locking element. The method includes slideably supporting the bridge for reciprocating linear movement, and angularly displacing the locking element into canted frictional engagement with the clamp shaft in direct response to rotation of the clamp shaft. The method further includes axially displacing the clamp shaft with continued rotation of the clamp shaft thereby forcibly drawing the moveable jaw toward the other jaw.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 27:
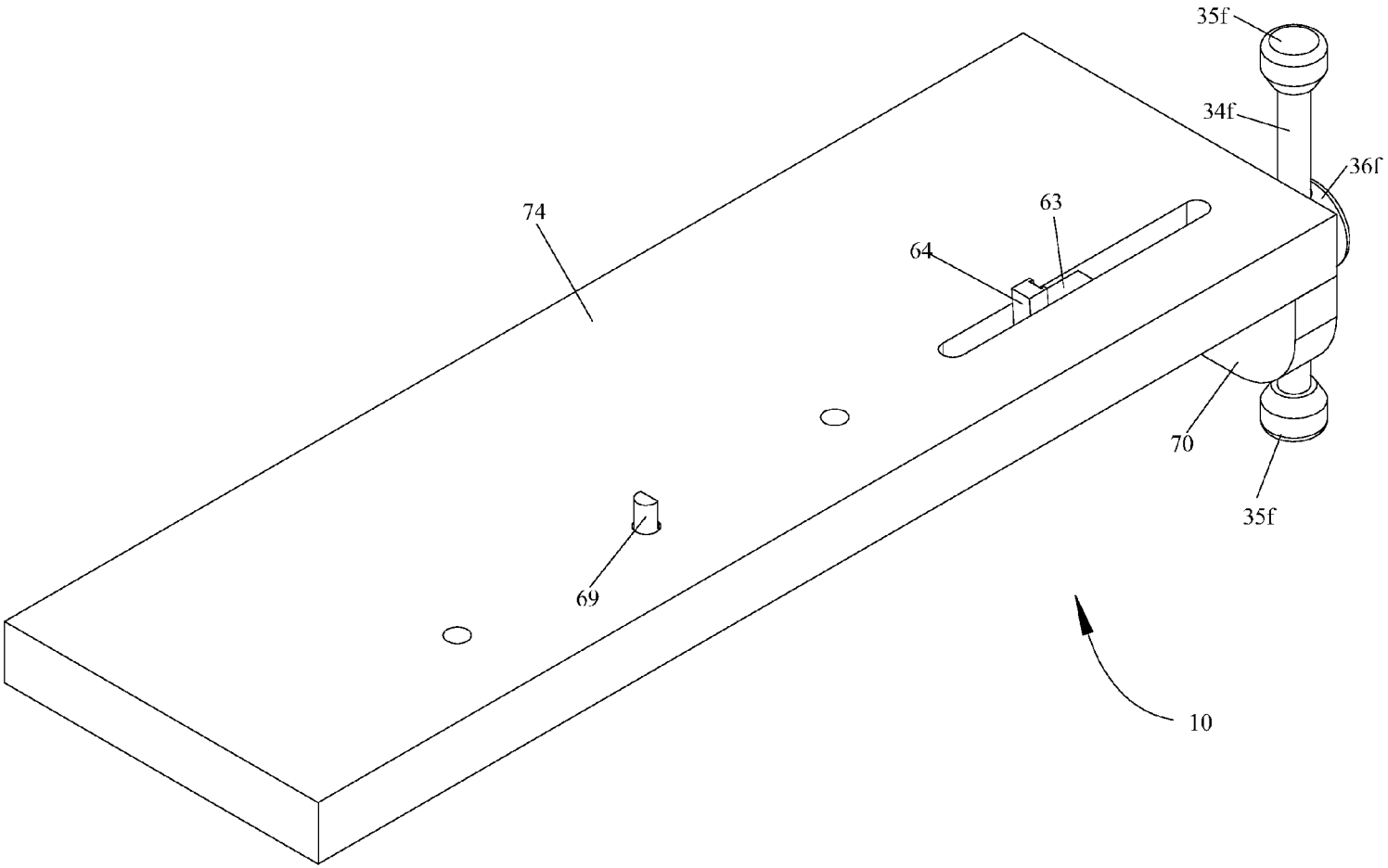
FIG. 27 is a perspective view showing a seventh embodiment of the vise of the present invention configured as an enclosed tail vise.
Figure 28:
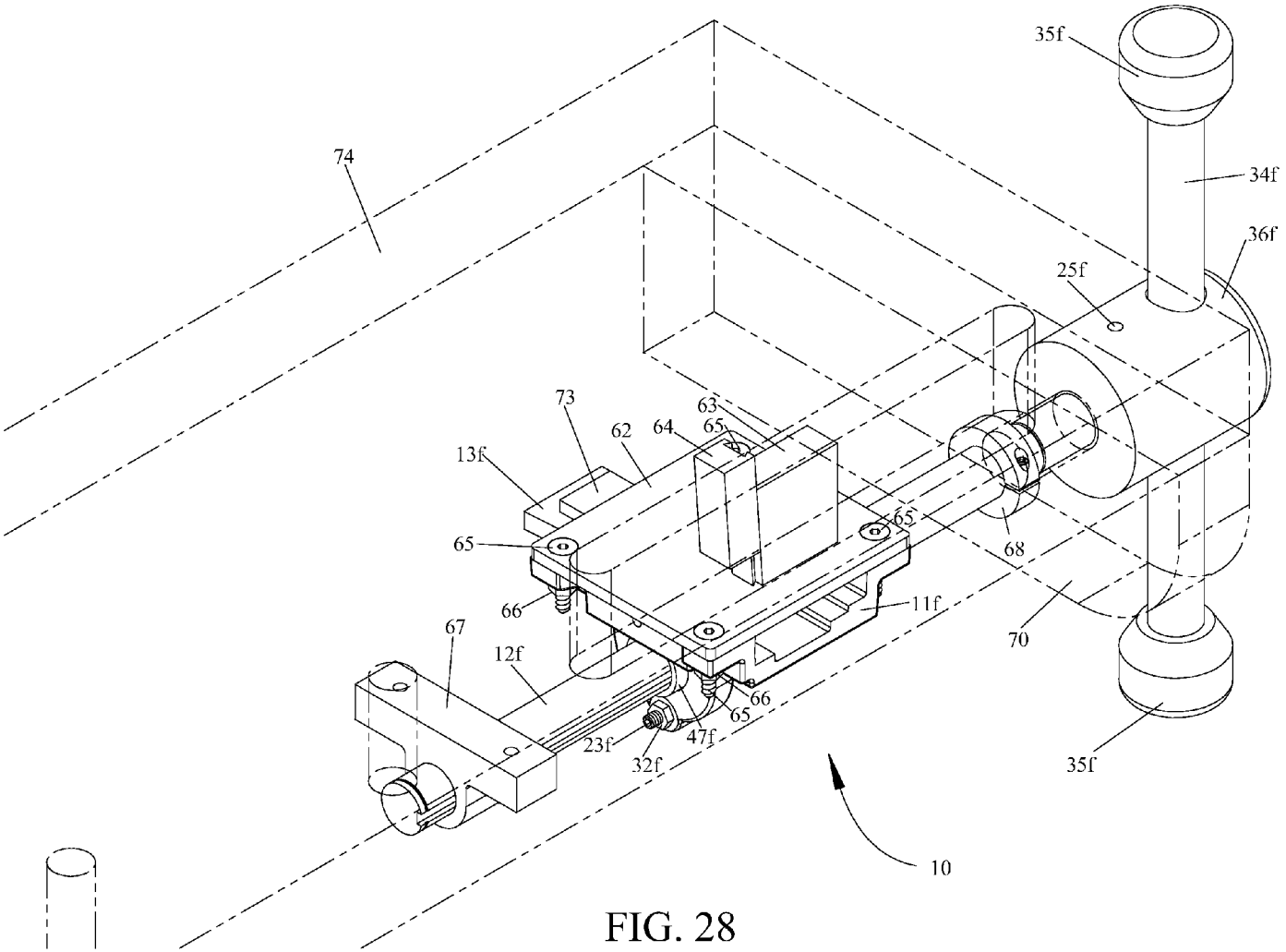
FIG. 28 is a partial perspective view showing a seventh embodiment of the vise of the present invention with the partial bench top and apron shown in phantom for clarity.
Figure 29:
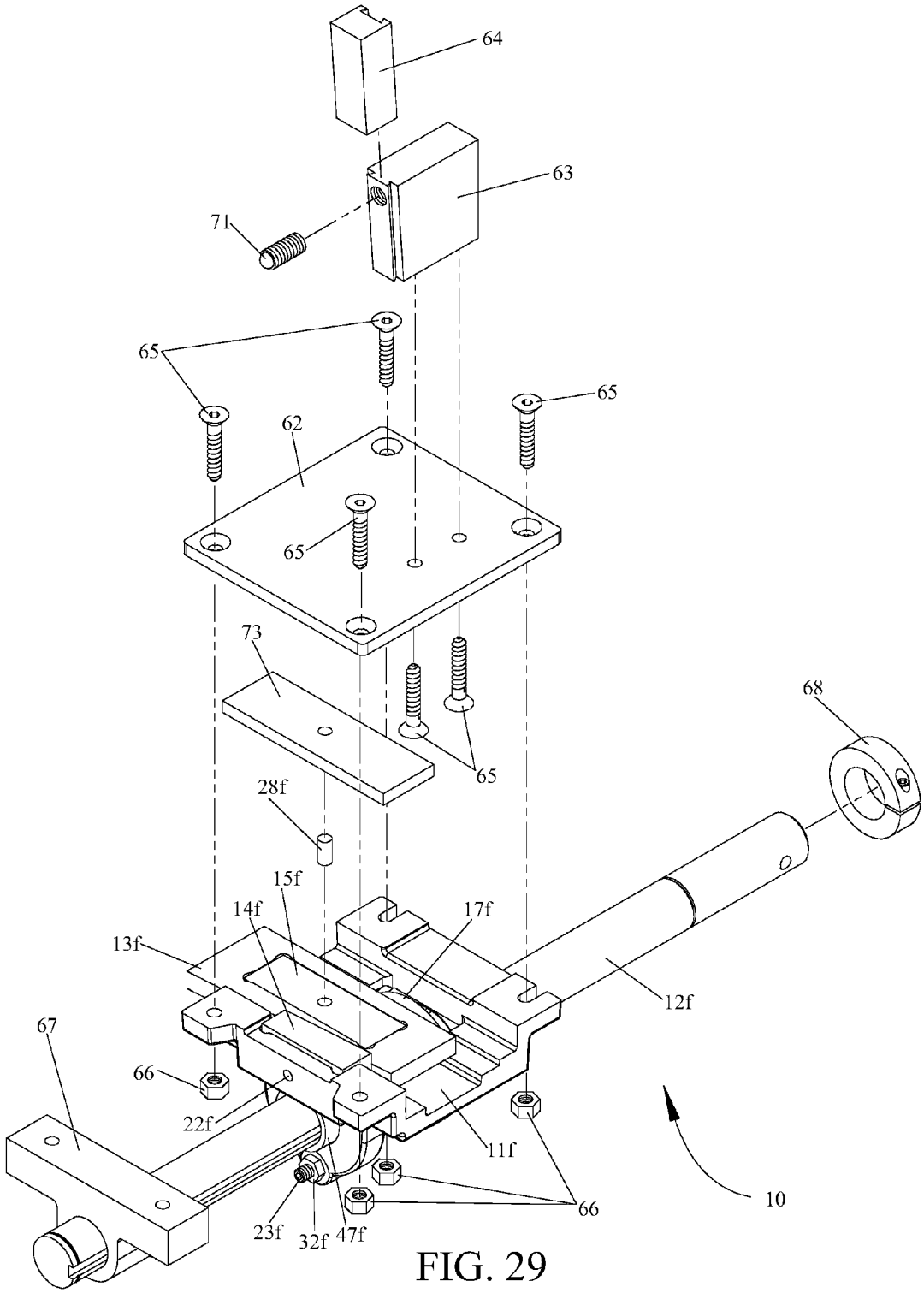
FIG. 29 is a partial perspective exploded view showing a seventh embodiment of the vise of the present invention.

Referring to the figures wherein like numerals indicate like or corresponding parts throughout the several views, with reference to FIGS. 1-4, the vise 10 of the present invention is shown in a preferred twin-shaft variation comprising first and second clamping sub-assemblies working in tandem. Among the several of the described embodiments utilizing twin shafts, components of the second clamping sub-assembly can be distinguished from components of the first clamping sub-assembly either by the use of prime designations or by the introduction of new reference numbers. It should be understood, however, that the invention may be practiced in single-shaft applications, and well as three-shaft (or more) applications due to its novel modular construction. One exemplary single-shaft embodiment is shown in FIGS. 27-29, with many other alternative expressions of a single-shaft design possible. Three-shaft (or more) applications will be appreciated by those skilled in the art in view of the following detailed descriptions.

Returning to FIGS. 1-4, the twin-shaft vise 10 includes two clamp shafts 12 and 12' which are parallel to one another and have a keyway along most of their length and slide freely through the flanged plain bearings 47 and 47' located in front holes in housings 11 and 11' and through pinions 16 and 16', locking elements 17 and 17', through springs 20 and 20', through washers 43 and 43' and through flanged plain bearing 47 and 47' located in the rear holes of housings 11 and 11'. Flanged plain bearings 47 and 47' may, for example, be constructed of an ultra high molecular weight polyethylene material to provide low friction to prevent stick-slip and provide good durability. The flanged plain bearings 47 and 47' may alternatively be made of Acetal, Polytetrafluoroethylene, Bronze or any other suitable material depending on the application. Generally speaking the further apart the clamp shafts 12 and 12' are spaced the lower the friction coefficient must be for the material used in flanged plain bearings 47 and 47' in order to avoid binding. Clamp shafts 12 and 12' are prevented from being pulled out of housings 11 and 11' by retaining rings 24 and 24' which are housed in grooves machined near the ends of clamp shafts 12 and 12'. Clamp shafts 12 and 12' are preferably constructed of mild carbon steel and are case hardened to provide a wear resistant surface, eliminate the need for oil lubrication and allow locking elements 17 and 17' to securely grab clamp shafts 12 and 12' as described later.

Housings 11 and 11' are securely and distally mounted to the underside of a typical workbench top 46 using lag screws (not shown) or other appropriate fasteners, fastened through the mounting holes and slots provided in housings 11 an 11'. Housings 11 and 11' may be constructed of ductile cast iron to provide strength, and may be formed as a unitary structure rather than as separate members in cases where the spacing between shafts 12, 12' is predetermined. Pins 28 and 28' are preferably press fit into corresponding holes in transfer bar 18 and pins 28 and 28' fit freely into suitable holes in racks 15 and 15' thus allowing racks 15 and 15' to freely rotate about pins 28 and 28'. Racks 15 and 15' engage pinions 16 and 16' through rectangular holes in bridges 13 and 13'. Transfer bar 18 is allowed to freely move while being constrained between the workbench top 46 and the housings 11 and 11'.

The transfer bar 18 is depicted here in a preferred embodiment in the form of a solid member constructed of sturdy bar stock. However, other configurations are certainly possible in order to achieve a motion transmitting member that interconnects the first 13 and second 13' bridges for simultaneously displacing these bridges 13, 13' in response to rotation of either the first clamp shaft 12 or the second clamp shaft 12'. For example, the transfer bar 18 could be replaced with a flexible motion transmitting core element that is slideably supported in a flexible conduit. Such an alternative construction would enable custom spacing between clamp shafts 12, 12' without changing the length of the motion transmitting member. Of course, many other variations are also possible.

Figure 1:
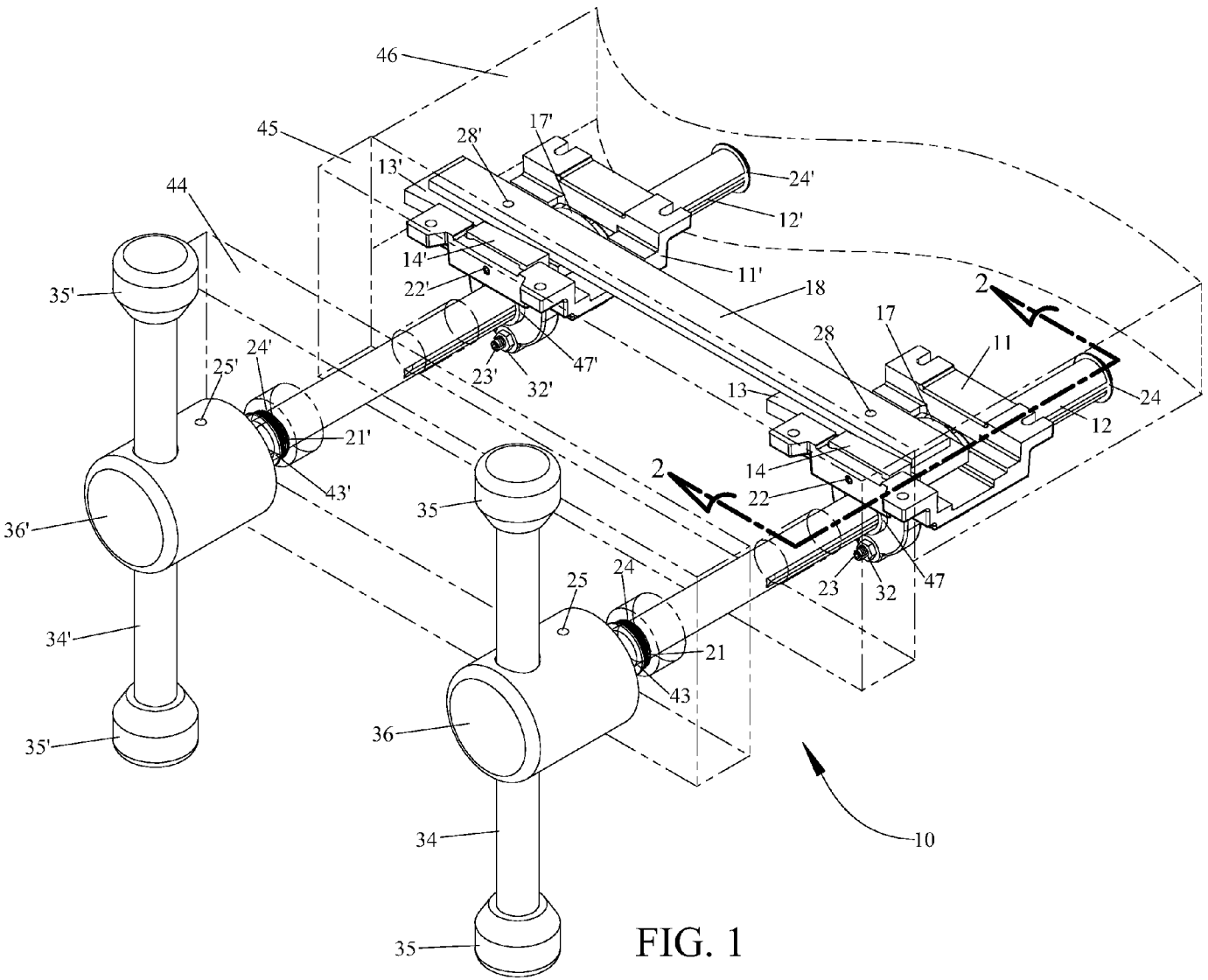
FIG. 1 is a perspective view of a first embodiment showing the vise of the present invention configured as a face or end vise with two handles, with the workbench top, rear vise jaw and moveable front vise jaw shown in phantom for clarity.
Figure 2:
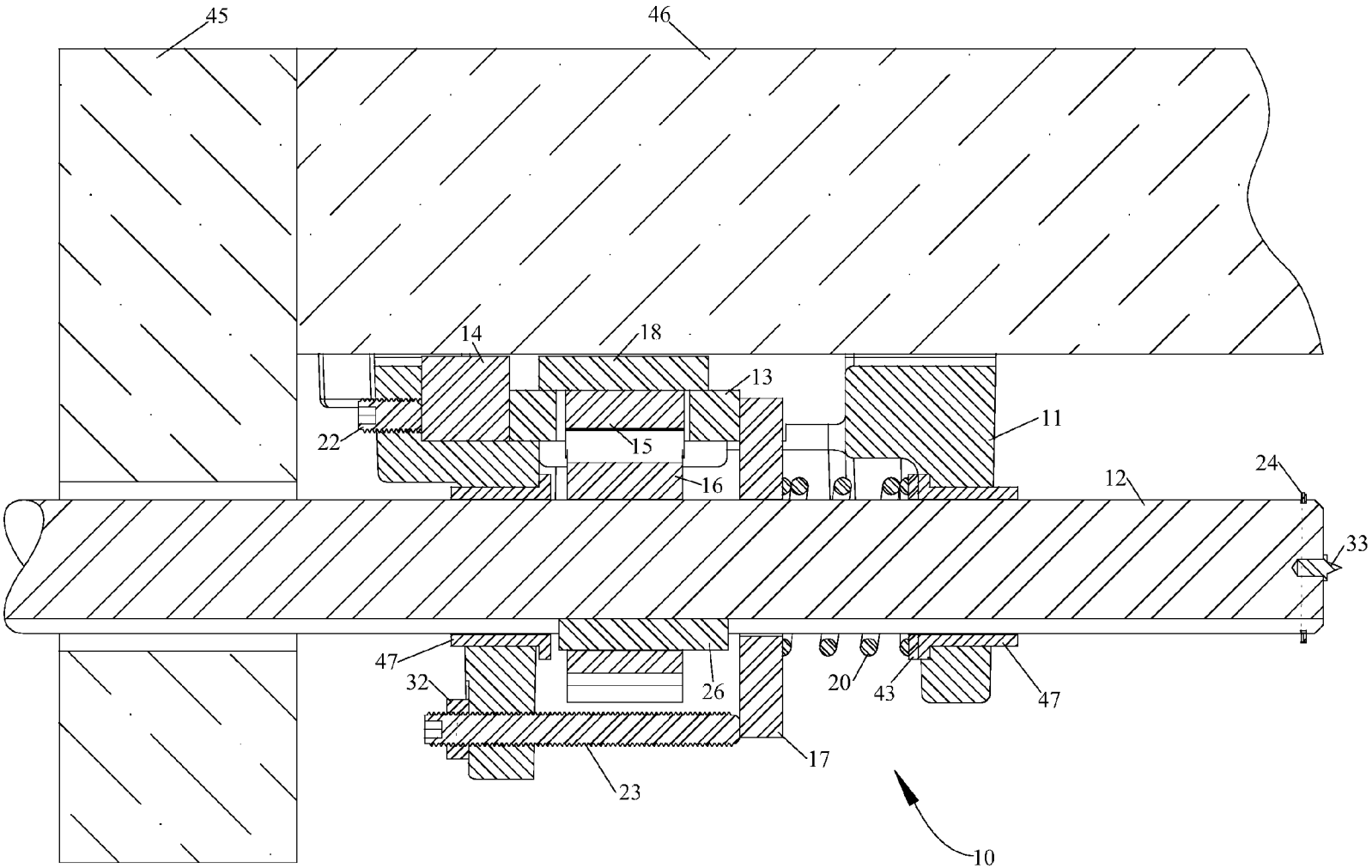
FIG. 2 is a partial right section view of a first embodiment of the vise of the present invention taken along line 2-2 in FIG. 1.
Figure 3:
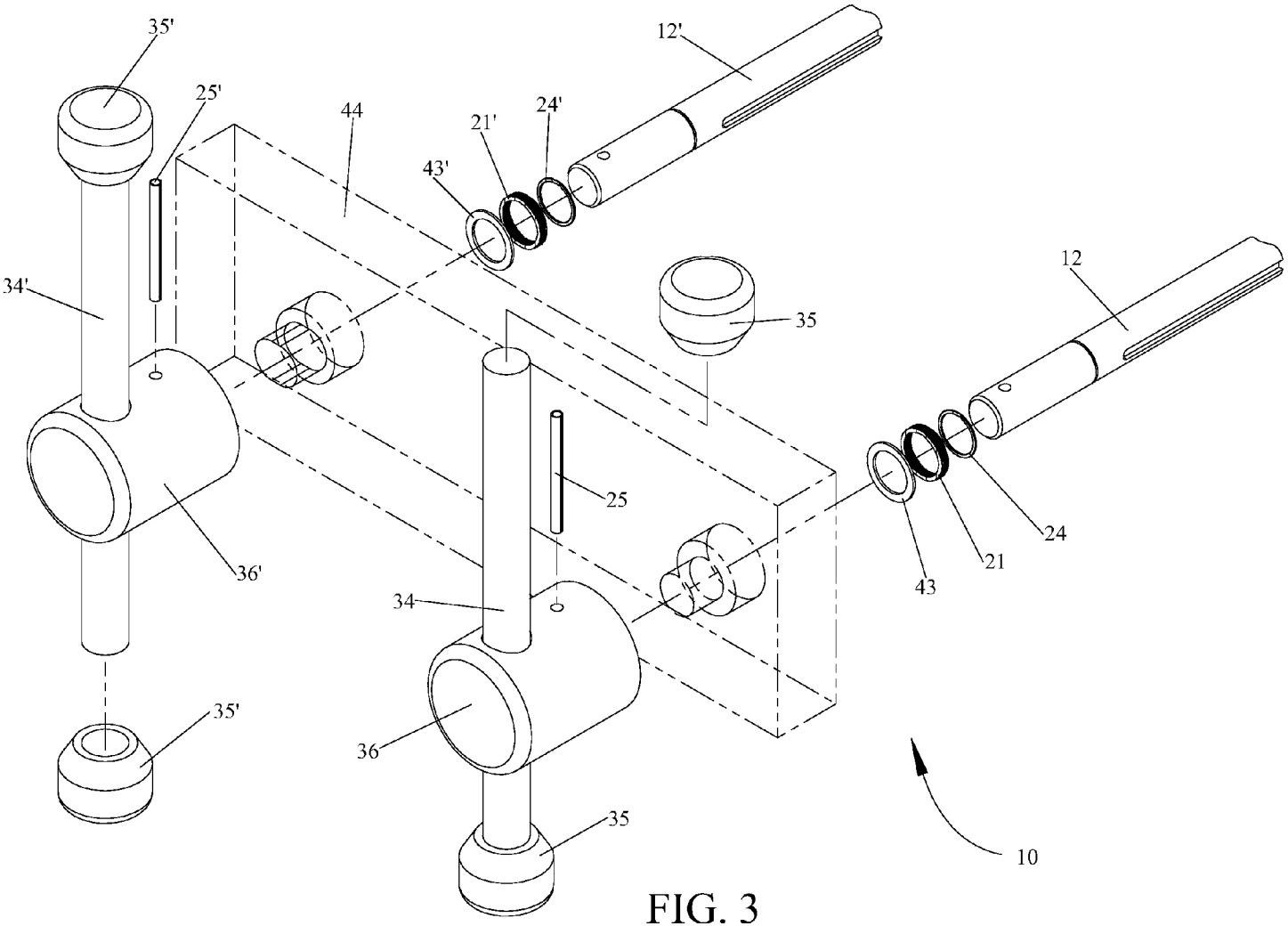
FIG. 3 is a partial perspective exploded view of a first embodiment of the vise of the present invention showing the clamp shaft assembly to the clamp hub through the moveable front vise jaw shown in phantom for clarity.

With reference to FIGS. 1, 2 and 3, clamp shaft 12 passes through a clearance hole in fixed rear vise jaw 45, wave spring 21 and washer 43 and through a circular hole and horizontal slot each bored part way through moveable front vise jaw 44 and into a close fitting bored hole in clamp hub 36. Retaining ring 24 is installed in a groove machined in clamp shaft 12 and retains wave spring 21 against clamp shaft 12. Clamp shaft 12 is securely affixed to clamp hub 36 by split pin 25 installed through a hole perpendicular to the close fitting bored hole in clamp hub 36 and into the cross hole in clamp shaft 12. Washer 43 fits tightly into the bored hole and has enough clearance to clamp shaft 12 to allow clamp shaft 12 to swivel slightly (approximately 2° for example) within the close fitting slot. Thus washer 43 locates moveable front vise jaw 44 laterally but allows moveable front vise jaw 44 to swivel slightly to accept slightly tapered work. Similarly, clamp shaft 12' passes through a clearance hole in fixed rear vise jaw 45, wave spring 21' and washer 43' and through a large circular hole and horizontal slot each bored part way through moveable front vise jaw 44 and into a close fitting axially bored hole in clamp hub 36'. Retaining ring 24' is installed in a groove machined in clamp shaft 12' and retains wave spring 21' against clamp shaft 12'. The horizontal slot in moveable front vise jaw 44 is very close fitting in the vertical direction to help stabilize moveable front vise jaw 44 when a workpiece is clamped high in the moveable front vise jaw 44 or dogs are utilized in moveable front vise jaw 44 for clamping work on the bench top. Wave springs 21 and 21' apply spring pressure between retaining rings 24 and 24' installed in grooves in clamp shafts 12 and 12' and through washers 43 and 43' and into the rear face of moveable front vise jaw 44 pulling clamps hubs close to the front face of moveable front vise jaw 44.

The combination of the horizontal slot in moveable front vise jaw and the spring action from wave springs 21 and 21' give compliance in the moveable front vise jaw 44 to allow moveable front vise jaw 44 to swivel slightly (approximately 2° for example) so that slightly tapered or irregular workpieces may be effectively secured. In addition, this compliance allows for wood movement in the bench top 46, especially if vise 10 is located in the end position which would typically have higher expansion and contraction due to cross grain. Further, the compliance in moveable front vise jaw 44 allows for clamps shafts that are not perfectly parallel and also takes up tolerance between the clamp hubs 36 and 36' so all clamping action is directed towards clamping, creating quicker clamping action (generally within 45° of handle movement). Clamp shaft 12' is securely affixed to clamp hub 36' by split pin 25' installed through a hole perpendicular to the close fitting bored hole in clamp hub 36' and into the cross hole in clamp shaft 12'. Handles 34 and 34' slide within each clamp hub 36 and 36' perpendicular to the longitudinal axes of clamp shafts 12 and 12' and retained by knobs 35 and 35'.

To facilitate ease of construction of moveable front vise jaw 44 and fixed rear vise jaw 45, a centrally located hole is provided in the end of clamp shafts 12 and 12' to allow the use of blind hole spotter 33 as shown in FIG. 2. With the blind hole spotter 33 installed in the centrally located hole of clamp shaft 12 or 12', the clamp shaft 12 or 12' may be slid forward to mark the clamp shaft 12 or 12' center location into moveable front vise jaw 44 and fixed rear vise jaw 45, greatly simplifying the hole and slot locations and simplifying construction of vise 10.

Figure 4:
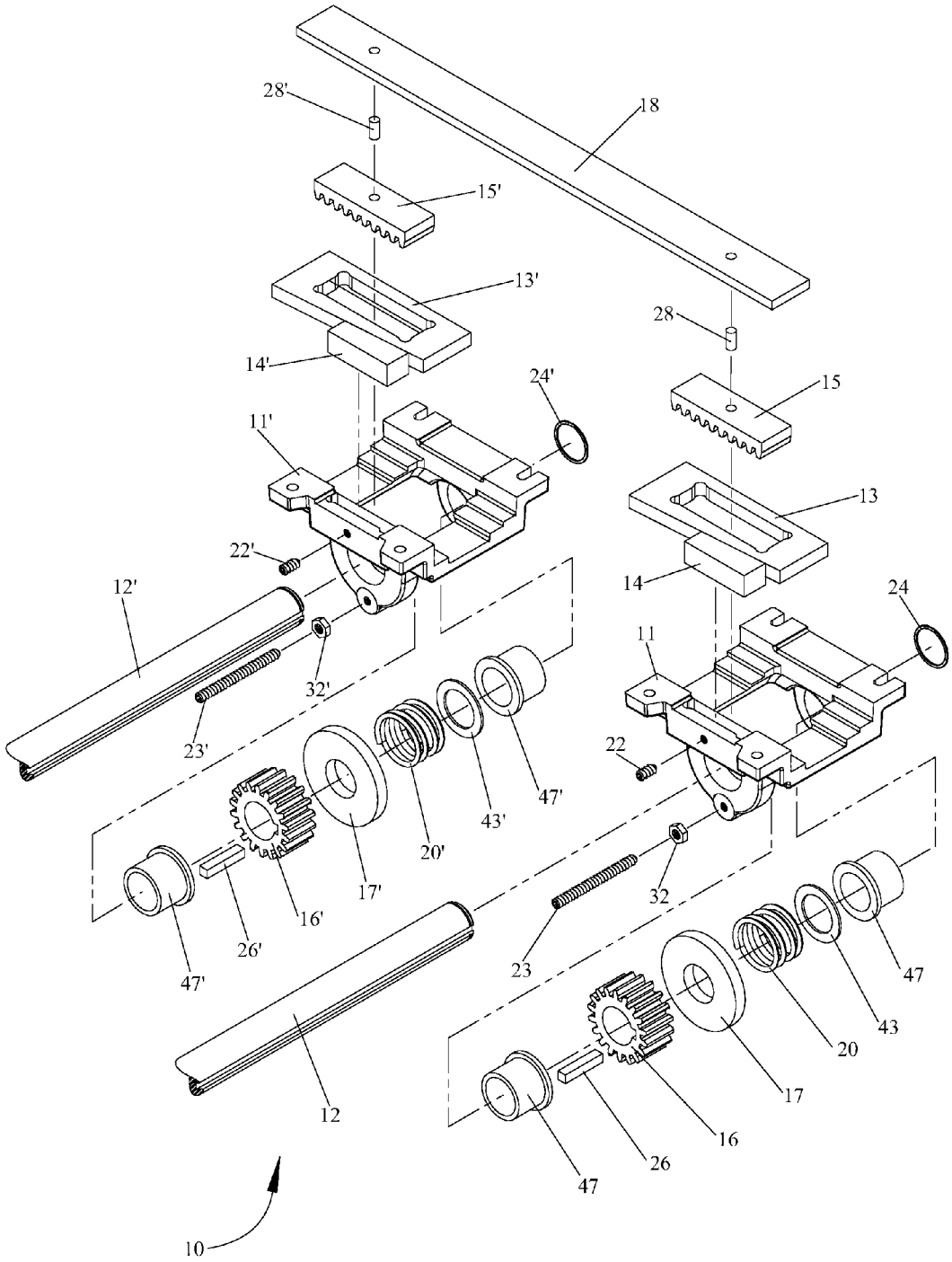
FIG. 4 is a partial perspective exploded view of a first embodiment of the vise of the present invention showing the mechanism which provides clamping action.

With reference to FIGS. 2 and 4, keys 26 and 26' slide freely in keyways in shafts 12 and 12' and in corresponding keyways in pinions 16 and 16' and transmit rotational movement of shafts 12 and 12' into pinions 16 and 16' while allowing translational movement of shafts 12 and 12' into and out of housings 11 and 11'. Bridges 13 and 13' have a centrally located rectangular hole which fits freely around pinions 16 and 16' and racks 15 and 15' and have one working edge which is perpendicular to the longitudinal axes of clamp shafts 12 and 12' and an opposite working edge which is skewed at a slight angle relative to the straight working edge. The angled working edges of each bridge 13 and 13' are in contact with the identically angled edges of wedges 14 and 14' which are free to move longitudinally in pockets in housings 11 and 11' but are constrained from moving laterally. The edges of bridge 13 and 13' that are perpendicular to clamp shafts 12 and 12' are in contact with locking elements 17 and 17'.

Racks 15 and 15' freely fit into the rectangular hole of bridges 13 and 13' and engage pinions 16 and 16'. Racks 15 and 15' may be machined with a very small lip on each end to better locate racks 15 and 15' vertically in the rectangular hole in bridges 13 and 13', otherwise racks 15 and 15' are held in vertical location by pinions 16 and 16' and the close lateral fit of racks 15 and 15' within the rectangular hole of bridges 13 and 13'. The rectangular hole in bridges 13 and 13' keep pinions 16 and 16' in alignment with racks 15 and 15' by nesting pinions 16 and 16' and racks 15 and 15' within the rectangular hole and converts the lateral motion of racks 15 and 15' into longitudinal motion by means of the wedging action created by the angled edges of wedges 14 and 14' acting against the corresponding angled edges of bridges 13 and 13'. Bridges 13 and 13' also function to limit the rotation of pinions 16 and 16' in order to prevent pinions 16 and 16' from running off the end of racks 15 and 15' by contacting the pinions 16 and 16' teeth at the end of travel. Bridges 13 and 13' may be constructed of low carbon steel and case hardened to eliminate galling between bridges 13 and 13' and wedges 14 and 14' and between bridges 13 and 13' and locking elements 17 and 17'. In one contemplated but not illustrated embodiment, the bridges 13, 13' could be integrated with their respective racks 15, 15', however there is some advantage to manufacturing them as loose piece components. The pinions 16, 16' are shown in a preferred, fully formed design. However those of skill will appreciate that each pinion could be formed with as few as one tooth or cam that interacts between a single pair of teeth or a slot in the racks 15, 15'. Alternatively still, the clamp shafts 12, 12' and bridges 13, 13' could be mechanically joined through a pivoting linkage or some other form of operative connection.

In this embodiment, rotary motion from clamp shaft 12 is transferred to pinion 16 through key 26 and is converted to translational motion by means of rack 15 which is engaged with pinion 16. The translational motion of rack 15 is transferred to rack 15' through pins 28 and 28' which are press fit into transfer bar 18. The translational motion from rack 15' is converted back to rotary motion by means of pinion 16' which is engaged with rack 15'. The rotary motion from pinion 16' is transferred to clamp shaft 12' through key 26'. In this way, clamp shafts 12 and 12' are thus allowed to operate in unison when clamping and the motion of all elements contained in housings 11 and 11' occur simultaneously and in synchronicity.

Transfer bar 18 may be fashioned to any specific length to give the desired center to center distance of clamp shafts 12 and 12' and correspondingly any desired length of moveable front vise jaw 44. It will be apparent to those skilled in the art that transfer bar 18 may also be constructed so as to be adjustable in length by use of bolted connections, multiple mounting holes or other suitable means.

In the unclamped state, bridges 13 and 13' are positioned by racks 15 and 15' at their shortest longitudinal width against wedges 14 and 14' at their shortest longitudinal width allowing locking elements 17 and 17' to contact release adjusting screws 23 and 23' by means of spring pressure from springs 20 and 20' bearing against housing 11 and 11' and locking elements 17 and 17'. The springs 20, 20' act as biasing members urging the body of the locking elements 17, 17' each toward a generally perpendicular orientation relative to the axes of their respective clamp shafts 12, 12'. In alternative embodiments, the springs 20, 20' could be replaced with other types of biasing members, such as Belleville washers, leaf springs, extension springs, torsion springs, or any other suitable devices. As can be seen in FIG. 4, the locking elements 17, 17' each have a generally planar body and a central hole in their body through which the respective clamp shaft 12, 12' slideably extends. Locking elements 17 and 17' are thus held perpendicular to clamp shafts 12 and 12' allowing clamp shafts 12 and 12' to freely pass through locking elements 17 and 17' and therefore moveable front vise jaw 44, which is fixed to clamp shafts 12 and 12', is free to be positioned against the workpiece whether square or slightly tapered.

Once moveable front vise jaw 44 is positioned against a workpiece, clamping begins as follows: rotation of handle 34 is transferred through clamp hub 36 into split pin 25 and into clamp shaft 12 and again transferred to pinion 16 through key 26 and its corresponding keyway in pinion 16 and clamp shaft 12. Rotation of pinion 16 is transferred into linear motion by engaging rack 15 which causes bridge 13 to translate identically. As the angled edge of bridge 13 translates against the corresponding angled edge of wedge 14 it is forced rearward against locking element 17 on a line which is radially displaced from the center of locking element 17 thus creating a moment about the center of locking element 17 and causing it to lock onto clamp shaft 12. Further rotation of handle 34 and thus clamp shaft 12 causes clamp shaft 12 to displace rearward to enable clamping. The motion transfer from transfer bar 18, previously described, causes identical clamping action to occur in clamp shaft 12' through identical movements of rack 15', pinion 16', bridge 13' and locking element 17'. Clamping may be initiated by rotation of either clamp handle 34 or 34'.

Figure 5:
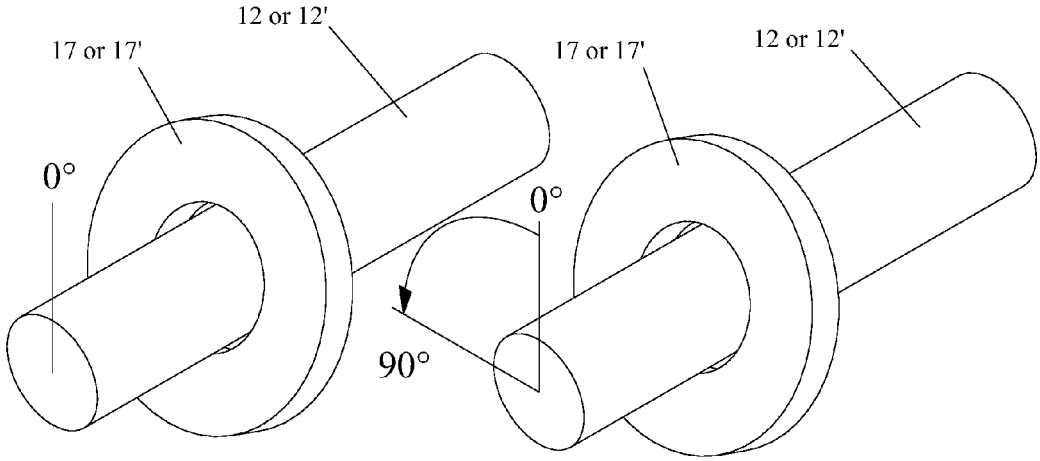
FIG. 5 is a perspective illustrative view of a first embodiment of the vise of the present invention which shows the relationship of the locking element to the clamp shaft when the clamp shaft is rotated.
Figure 6:
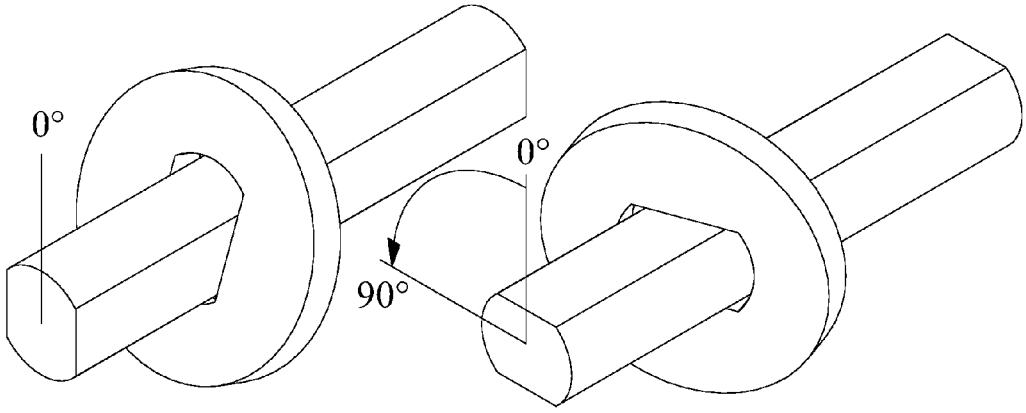
FIG. 6 is a perspective illustrative view of prior art locking elements which shows the relationship of the locking element to the clamp shaft when the clamp shaft is rotated.

Locking elements 17 and 17' translate longitudinally with their respective shaft 12, 12' while maintaining a planar relationship with bridges 13 and 13' by rotating about shafts 12 and 12' while locking elements 17 and 17' are simultaneously locking against shafts 12 and 12' as depicted in FIG. 5. The use of soft low carbon steel in locking elements 17 and 17' combined with case hardened steel in clamp shafts 12 and 12' allow locking elements 17 and 17' to securely grip clamp shafts 12 and 12' even though there is relative movement between clamp shafts 12 and 12' and locking elements 17 and 17'.

The unique motion and combination of case hardened steel in clamp shafts 12 and 12' and soft low carbon steel in locking elements 17 and 17' of the current invention allows the locking elements 17 and 17' to transmit the rotational clamping force and the translational clamping motion without being keyed to the shaft and without requiring a helical ramp or other complicated means used in prior art. The motion of locking elements 17 and 17' allow the centrally located hole and the periphery of locking elements 17 and 17' to be circular, greatly simplifying construction. Since locking elements 17 and 17' rotate freely about clamp shafts 12 and 12', locking elements 17 and 17' wear evenly about the entire circumference of the hole in locking elements 17 and 17' thereby increasing the durability of the part significantly. In contrast, prior art locking elements do not have relative motion between the locking element and the shaft. Instead, they typically require flats or other suitable means machined into the shaft and locking element so that the locking element and shaft turn in unison.

Synchronization and fine tune adjustment of the clamping action between the corresponding clamp shafts 12 and 12' is accomplished by means of clamp adjusting screws 22 and 22' which are threaded into housings 11 and 11' and bear against wedges 14 and 14'. By threading the clamp adjusting screws 12 and 12' in or out, wedges 14 and 14' are advanced or retracted against bridges 13 and 13' which in turn are advanced or retracted against locking elements 17 and 17'. This adjustment causes the clamping action to be respectively advanced or delayed which allows the two clamp shafts to be precisely and simply synchronized. The clamp adjusting screws 22 and 22' also allows compensation for wear and tolerances in manufacturing. An additional benefit of clamp adjusting screws 22 and 22' is that by retracting the screws significantly the maximum clamping force may be reduced to allow clamping of delicate or fragile workpieces. When clamp adjusting screws 22 and 22' are advanced or retracted, locking elements 17 and 17' may not release from clamp shafts 12 and 12' properly due to the altered angular relationship of locking element 17 and 17' to clamp shafts 12 and 12'.

A generally perpendicular relationship of locking elements 17 and 17' to clamp shafts 12 and 12' is required to unlock locking elements 17 and 17' from clamp shafts 12 and 12'. To allow for proper release of locking elements 17 and 17', release adjusting screws 23 and 23' are threaded into housings 11 and 11' and contact locking elements 17 and 17' at their periphery. Release adjusting screws 23 and 23' are advanced against locking elements 17 and 17' when in the unclamped state until locking elements 17 and 17', with the aid of spring pressure from springs 20 and 20', release from clamp shafts 12 and 12' by attaining a perpendicular relationship to clamp shafts 12 and 12'. Jam nuts 32 and 32' are tightened against housings 11 and 11' to prevent release adjusting screws 23 and 23' from inadvertently moving after they are adjusted.

Figure 7:
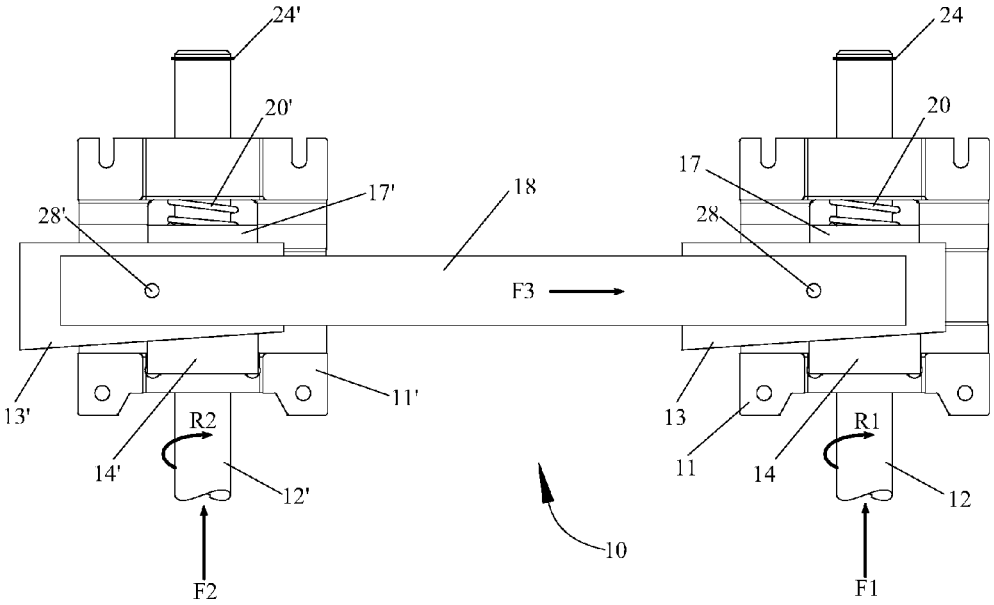
FIG. 7 is a partial top plan view of a first embodiment showing the vise of the present invention in the unclamped state and configured for clamping by clockwise rotation of the clamp handle.
Figure 8:
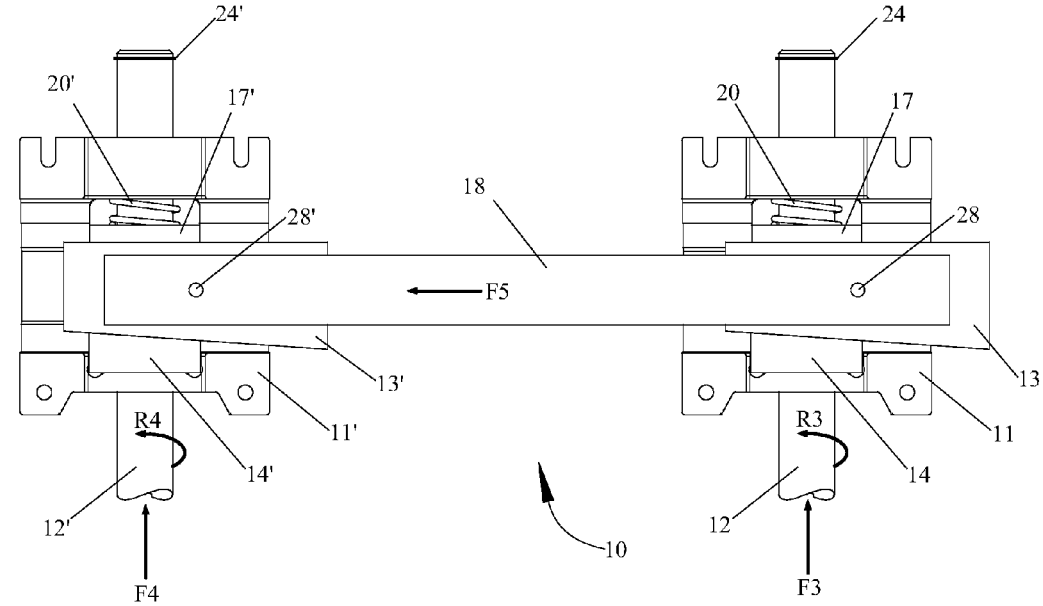
FIG. 8 is a partial top plan view of a first embodiment showing the vise of the present invention in the unclamped state and configured for clamping by counter-clockwise rotation of the clamp handle.

Vise 10 can be configured to clamp with clockwise rotation of clamp handles 34 and 34' or with counter-clockwise rotation of clamp handles 34 and 34'. When bridges 13 and 13' and wedges 14 and 14' are oriented as shown in FIG. 7, clockwise (CW) rotation R1 or R2 of clamp handle 34 or 34' enables clamping forces F1 and F2 to be applied to clamp shafts 12 and 12' and translational force F3 to be applied through transfer bar 18. To configure vise 10 to clamp with counter-clockwise (CCW) rotation of clamp handles 34 and 34', bridges 13 and 13' and wedges 14 and 14' are simply removed from housings 11 and 11' rotated 180° about a longitudinal axis and re-installed into housings 11 and 11' as depicted in FIG. 8. Counter-clockwise (CCW) rotation R3 or R4 of clamp handle 34 or 34' enables clamping forces F3 and F4 to be applied to clamp shafts 12 and 12' and translational force F5 applied through transfer bar 18. In other words, the bridges 13, 13' are preferably selectively invertible relative to their respective racks 15, 15'. This simple inversion process allows the entire vise assembly 10 to be changed from a CW closing to a CCW closing configuration (and vice versa) which could be helpful for right-handed vs. left-handed operators or depending up in the set-up of the vise 10 for particular operations. Similarly, the bridges 13, 13' and cooperating wedges 14, 14' can be re-oriented to the opposite side of the housings 11, 11' to cause the jaws to operate with a spreading motion rather than a clamping motion in response to continued rotation of the clamp shafts 12, 12'.

Figure 9:
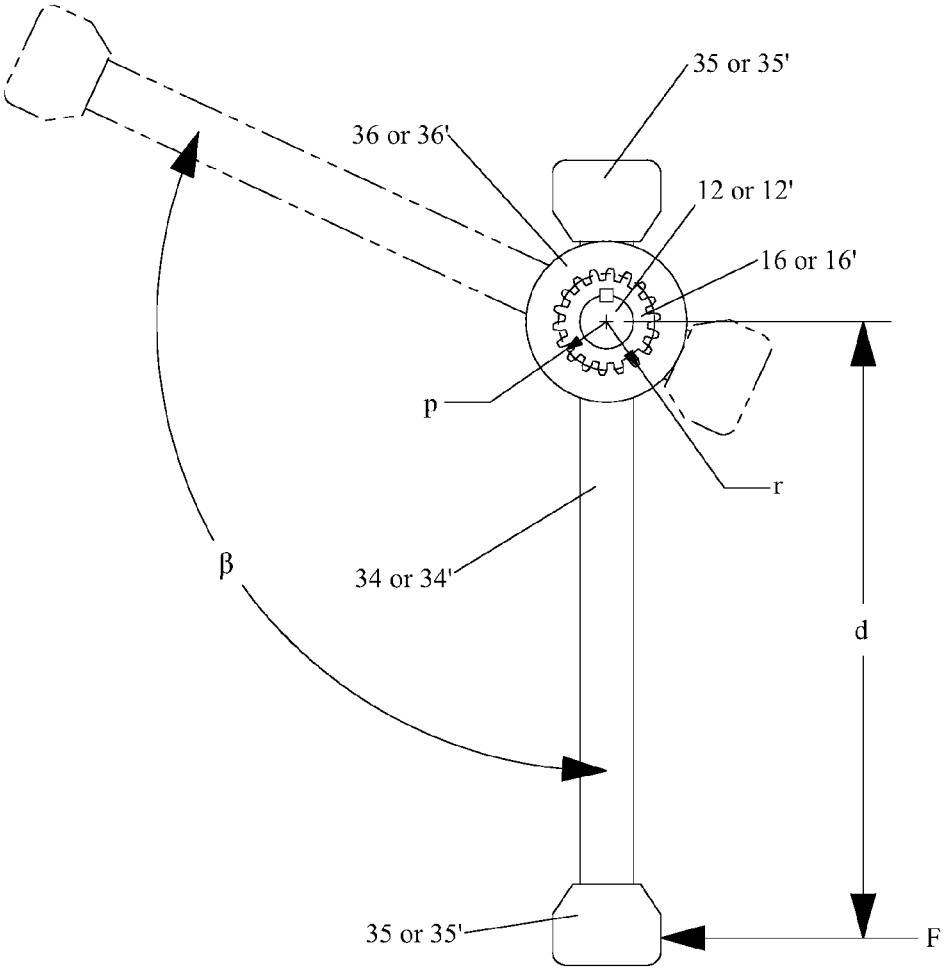
FIG. 9 is a partial rear illustrative view of a first embodiment showing the vise of the present invention and the relationship of applied handle force to the centerline of the clamp shaft.
Figure 10:
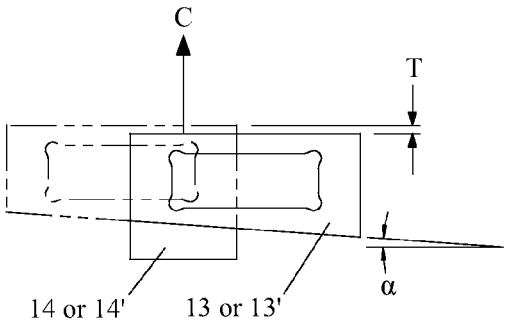
FIG. 10 is a partial plan illustrative view of a first embodiment showing the vise of the present invention, with the bridge in the clamped position shown in phantom lines, which shows the direction of the clamping force, the angle of the wedge and bridge and the direction of motion during clamping.

With reference to FIGS. 9 and 10, the clamping force C, handle force F, and total clamp travel T, may be changed in vise 10 by changing the angle $\alpha$ of the contacting surfaces between bridges 13 and 13' and wedges 14 and 14' and by changing the number of teeth on racks 15 and 15'. The clamp force C and total clamp travel T for angle $\alpha$ of wedges 14 and 14' and bridges 13 and 13' and for number of rack teeth Nr of racks 15 and 15' may be determined from the following formulas:

$$C = \left(\frac{Fd}{p}\right)\text{COTAN}\alpha$$

and:

$$T = \beta\left(\frac{\pi r}{180}\right)\text{TAN}\alpha$$

where:

C=Clamping force applied through clamp shafts 12 and 12' and moveable front vise jaw 44 to clamp workpiece.

F=Handle force applied at distance d from clamp shafts 12 or 12' centerline to point of force application on Handle 34 or 34'.

d=Distance from clamp shafts 12 or 12' centerline to point where handle force F is applied on handle 34 or 34'.

p=Pitch line radius of pinions 16 and 16'.

α=Angle of contacting surfaces of bridges 13 and 13' and wedges 14 and 14' relative to a perpendicular line to the longitudinal axes of shafts 12 and 12'.

T=Total clamp travel distance of clamp shafts 12 and 12' when clamp handle 34 or 34' is rotated through the maximum allowed angular rotation β.

β=Maximum angular rotation of clamp handle 34 or 34'. The maximum rotation of clamp handle 34 or 34' is limited by the number of teeth on racks 15 and 15' and the number of teeth on pinions 16 and 16' and may be calculated from the following formula:

$$\beta = \left[(N_r - 1)\left(\frac{360}{N_p}\right)\right] - \text{COS}^{-1}\left(\frac{r - 0.049}{r}\right)$$

where:

$N_r$=Number of teeth on racks 15 and 15'

$N_p$=Number of teeth on pinions 16 and 16' r=Outside radius of pinions 16 and 16'

Assuming handle force F remains constant, as angle α is decreased clamp force C increases and total clamp travel T decreases. Correspondingly as angle α is increased, clamp force C decreases and total clamp travel T increases. Assuming handle force F remains constant, vise 10 can thereby be configured, by increasing angle α on bridges 13 and 13' and wedges 14 and 14', to clamp highly compressible materials with more total clamp travel T and less clamp force C applied to moveable front vise jaw 44 and thus less clamp force applied to the workpiece being clamped. Vise 10 may also be configured, by decreasing angle α on bridges 13 and 13' and wedges 14 and 14', to clamp highly dense materials with less total clamp travel T and more clamp force C applied to moveable front vise jaw 44. Total clamp travel T may be increased by adding teeth to racks 15 and 15' effectively lengthening racks 15 and 15'. Adding teeth to racks 15 and 15' increases the maximum angular rotation of clamp handles 34 and 34' and thus increases total clamp travel T. Total clamp travel T may be decreased by subtracting teeth from racks 15 and 15' effectively shortening racks 15 and 15'. Subtracting teeth from racks 15 and 15' decreases the maximum angular rotation of clamp handles 34 and 34' and thus decreases total clamp travel T.

Figure 11:
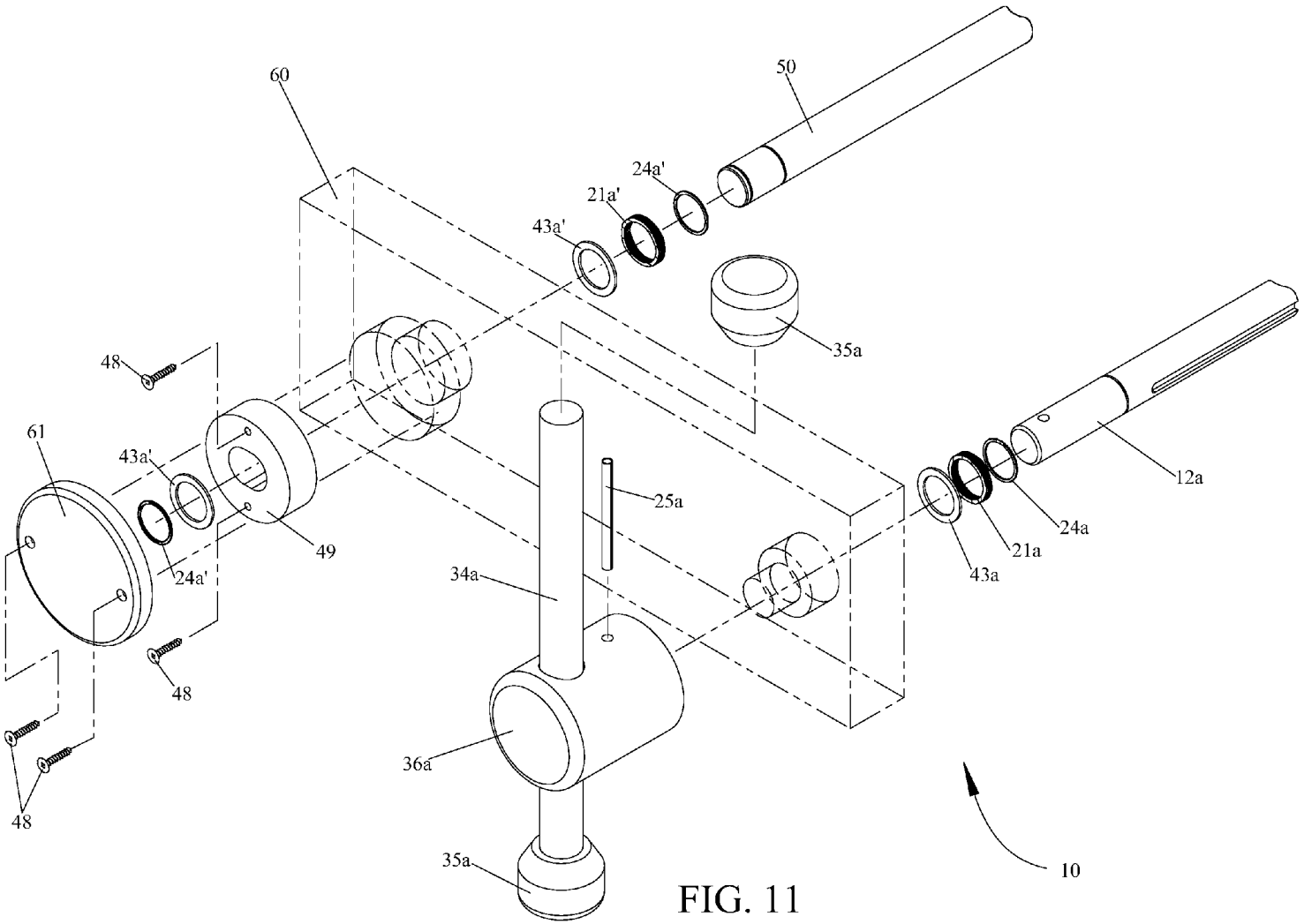
FIG. 11 is a partial perspective exploded view of a second embodiment of the vise of the present invention configured as a single handle vise showing the clamp shaft assembly to the clamp hub through the moveable front vise jaw shown in phantom for clarity.
Figure 12:
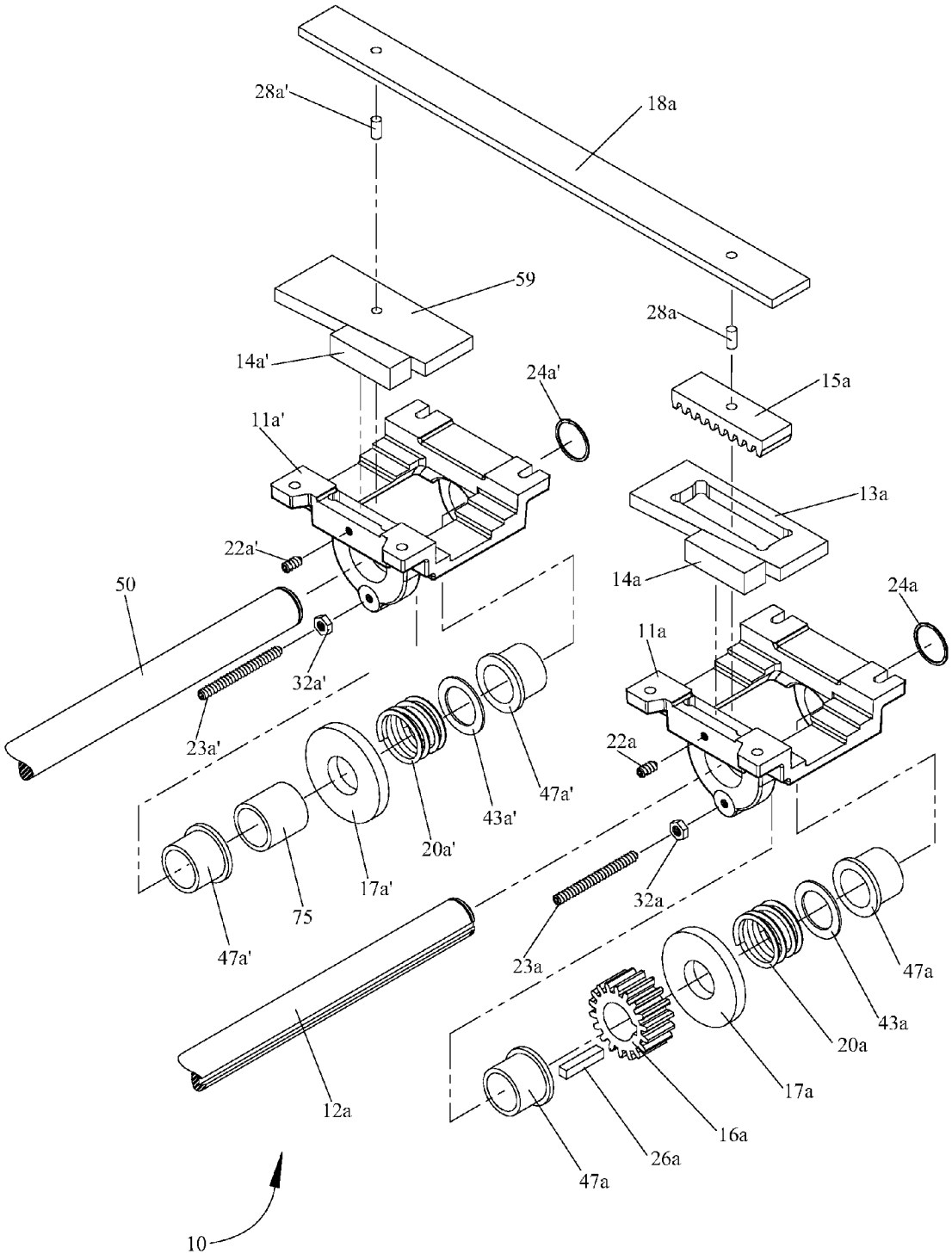
FIG. 12 is a partial perspective exploded view of a second embodiment of the vise of the present invention showing the mechanism which provides clamping action.

The structure of a second embodiment shown in FIGS. 11-12 is functionally similar to that of FIGS. 1-10. Reference numerals for functionally identical structure carry suffix "a" in FIGS. 11-12.

In this arrangement, a single clamp handle 34*a*, clamp hub 36*a* and knobs 35*a* is utilized. This configuration may be necessary when the center to center distance of clamp shafts 12*a* and 50 are close enough in proximity to interfere with each other and hinder operation of vise 10. All structure associated with clamp shaft 12*a* is substantially identical to structure detailed previously in the first embodiment. Since a single handle only is used in this embodiment, clamp shaft 50 is constructed without a keyway or a cross hole and has two distally spaced grooves machined into the forward most area of clamp shaft 50. The rearmost groove of clamp shaft 50 accepts retaining ring 24*a*'. Wave spring 21*a*' bears against retaining ring 24*a*' and applies spring pressure through washer 43*a*' and against the rear face of compliance ring 49. Clamp shaft 50 protrudes slightly through compliance ring 49 and is retained with retaining ring 24*a*' installed in the forward most groove machined in clamp shaft 50, bearing against the forward most washer 43*a*'. Compliance ring 49 is installed into a circular pocket milled into single handle moveable front vise jaw 60 and secured with wood screws 48. A decorative cover plate 61 may be fastened to single handle moveable front vise jaw 60 with wood screws 48 to provide an attractive appearance. Compliance ring 49 allows the high clamping forces of vise 10 to be applied directly to single handle moveable front vise jaw 60 and not through screws or other means which may fail under load. The slot milled into compliance ring 49 also provides compliance to single handle moveable front vise jaw 60 in the same manner as described in the first embodiment.

With reference to FIG. 12, clamp shaft 50 does not rotate and thus does not require a pinion 16, key 26, or rack 15 as described in the first embodiment. Spacer 75 is installed on shaft 50 between front flanged plain bearing 47*a*' and locking element 17*a*' to retain front flanged plain bearing 47*a*'. Spacer 75 may be constructed of plastic such as Polyvinyl chloride and with a sliding clearance to allow rotation and translation. Since a rack 15 as described in the first embodiment is not required with clamp shaft 50, bridge 59 is constructed with a reamed hole to accept pin 28*a*' instead of a rectangular hole. Bridge 59 is allowed to freely rotate about pin 28*a*'. in all other aspects, bridge 59 is similar to bridge 13*a*. All rotational clamping motion is applied through clamp shaft 12*a*; the motion of clamp shaft 50 is translational only. All clamping and release functions are identical to the first embodiment. Clamp shaft 50, clamp hub 36*a*, handle 34*a* and knobs 35*a* may be positioned on the right or left side of single handle moveable front vise jaw 60.

The structure of a third embodiment shown in FIGS. 13-17 is functionally identical to that of FIGS. 1-10. Reference numerals for functionally identical structure carry suffix "b" in FIGS. 13-17.

Figure 13:
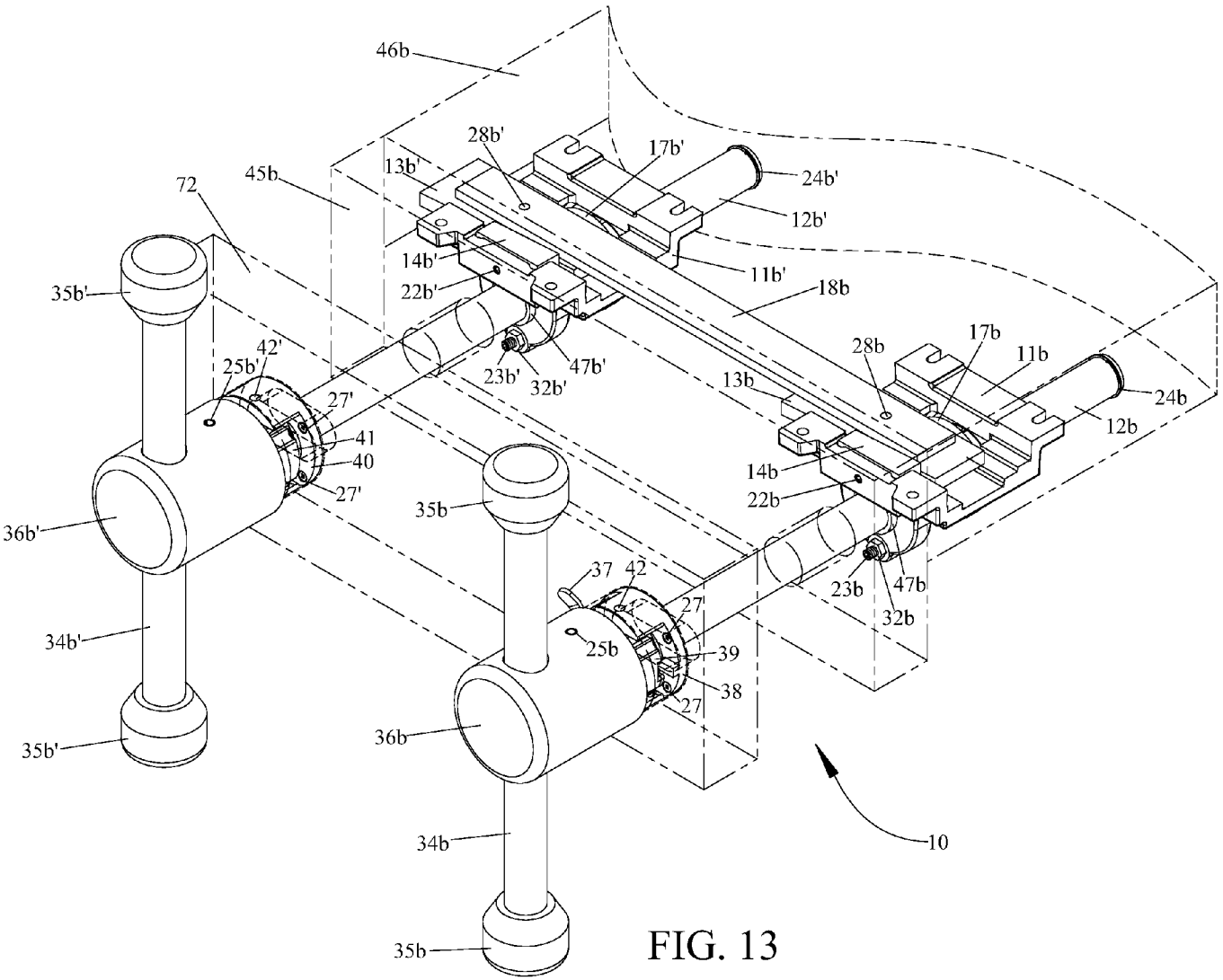
FIG. 13 is a perspective view showing a third embodiment of the vise of the present invention configured as a face or end vise with two handles and a swivel front jaw, with the workbench top, rear vise jaw and moveable front vise jaw shown in phantom for clarity.
Figure 14:
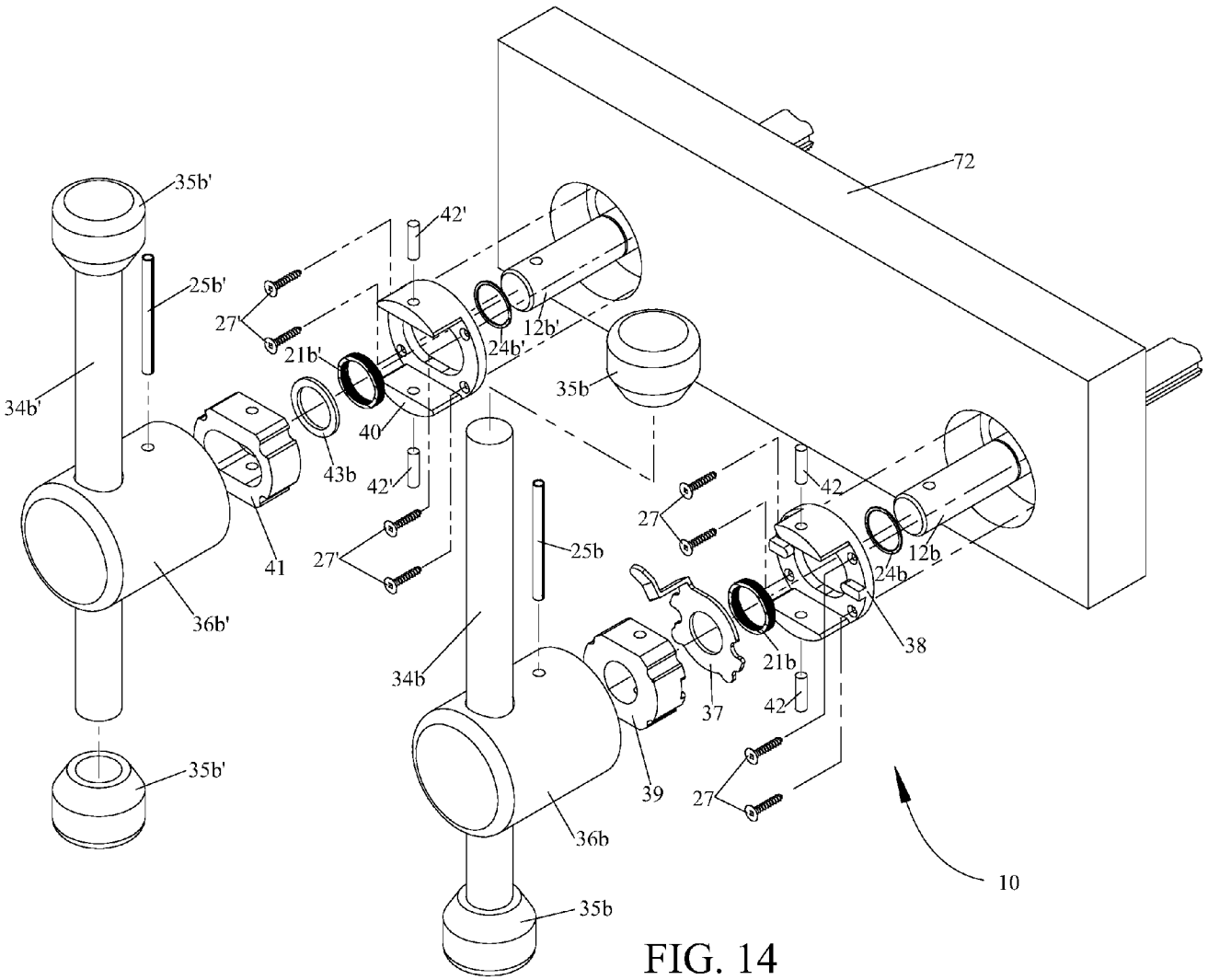
FIG. 14 is a partial perspective exploded view of a third embodiment of the vise of the present invention showing the clamp shaft assembly to the clamp hub through the moveable front vise jaw.
Figure 15:
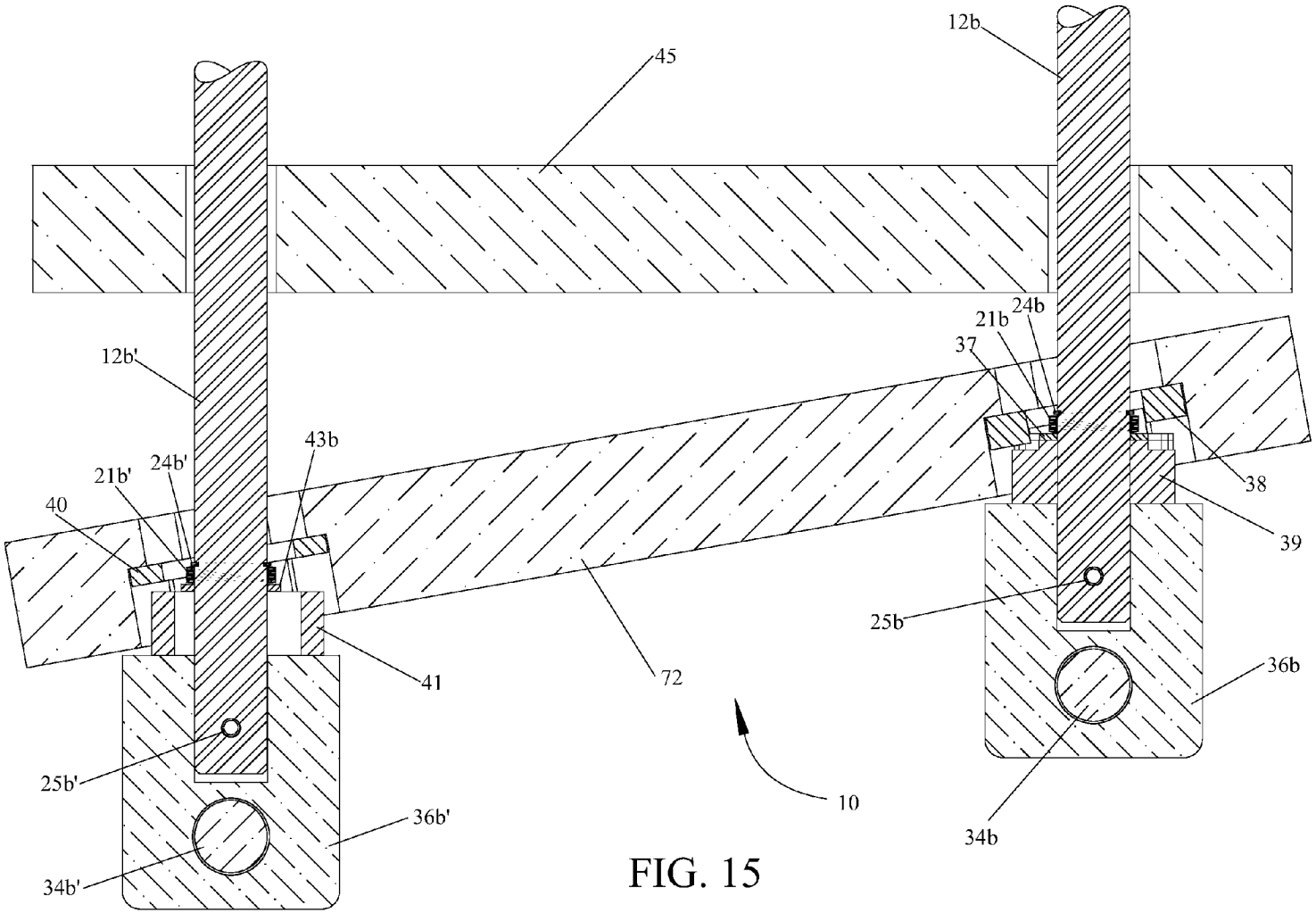
FIG. 15 is a partial horizontal section view showing a third embodiment of the vise of the present invention and showing the moveable front vise jaw in a swiveled position.

In this configuration, moveable front vise jaw 72 is able to swivel to enable tapered objects or irregular shaped objects such as carvings or guitars while maintaining good contact between clamp hubs 36 and 36' and moveable front vise jaw 72. With reference to FIGS. 13, 14 and 15, clamp shaft 12*b* passes through a clearance hole in moveable front vise jaw 72 and through swivel base 38, wave spring 21*b*, lock ring 37 and swivel ring 39 and into clamp hub 36*b*. Similarly, clamp shaft 12*b*' passes through a clearance hole in moveable front vise jaw 72 and through compensator base 40, wave spring 21*b*, washer 43*b* and compensator ring 41 and into clamp hub 36*b*'. Compensator base 40 and swivel base 38 are rigidly mounted within circular pockets in moveable front vise jaw 72 using wood screws 27 and 27'. When mounted, compensator base 40 and swivel base 38 are flush with the outer surface of moveable front vise jaw 72. Each clamp hub 36*b* and 36*b*' is fixed on the end of its respective clamp shaft 12*b* and 12*b*' with spring pins 25*b* and 25*b*' or other appropriate means. Handles 34*b* and 34*b*' slide within each clamp hub 36*b* and

36*b*' perpendicular to the longitudinal axes of clamp shafts 12*b* and 12*b*' and retained by knobs 35*b* and 35*b*'.

Clamp shaft 12*b* passes through a circular hole in swivel ring 39 and is allowed to freely rotate. Lock ring 37 is held in firm contact with swivel ring 39 by spring force from wave spring 21*b* acting against retaining ring 24*b* which is housed within a groove in clamp shaft 12*b*. Clamp hub 36*b* is allowed to freely rotate against swivel ring 39 and is kept in close contact by spring force from wave spring 21*b*. Two pivot pins 42, coaxially located on either side of clamp shaft 12*b*, pass through holes in swivel ring 39 and swivel base 38. Pivot pins 42 are retained on the outside by the circular pocket in moveable front vise jaw 44 and on the inside by clamp shaft 12. Once mounted swivel ring 39 stands proud of the front face of moveable front vise jaw 44 so that when moveable front vise jaw 72 is swiveled a prescribed arc in either direction, clamp hub 36*b* does not contact the front face of moveable front vise jaw 72 as depicted in FIG. 15.

Figure 16:
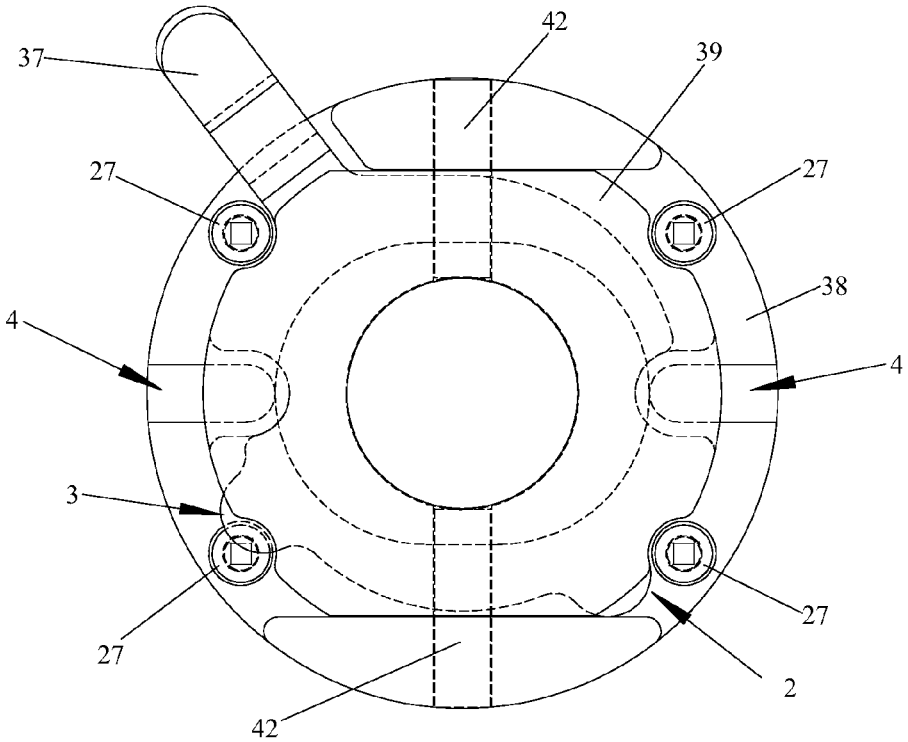
FIG. 16 is a partial front illustrative view of a third embodiment of the present invention showing the swivel mechanism in the unlocked position.

With reference to FIG. 16, when lock ring 37 is rotated until stop tab 2 contacts horizontal member of swivel base 38, openings in lock ring 37 align with swivel stops 4 on swivel base 38 allowing swivel base 38 and moveable front vise jaw 72, since it is firmly affixed to swivel base 38, to freely swivel about pivot pins 42 in either direction. The swivel angle is limited (for example, to 10° arc) by swivel stops 4 on swivel base 38 contacting the bottom of machined pockets in swivel ring 39.

Figure 17:
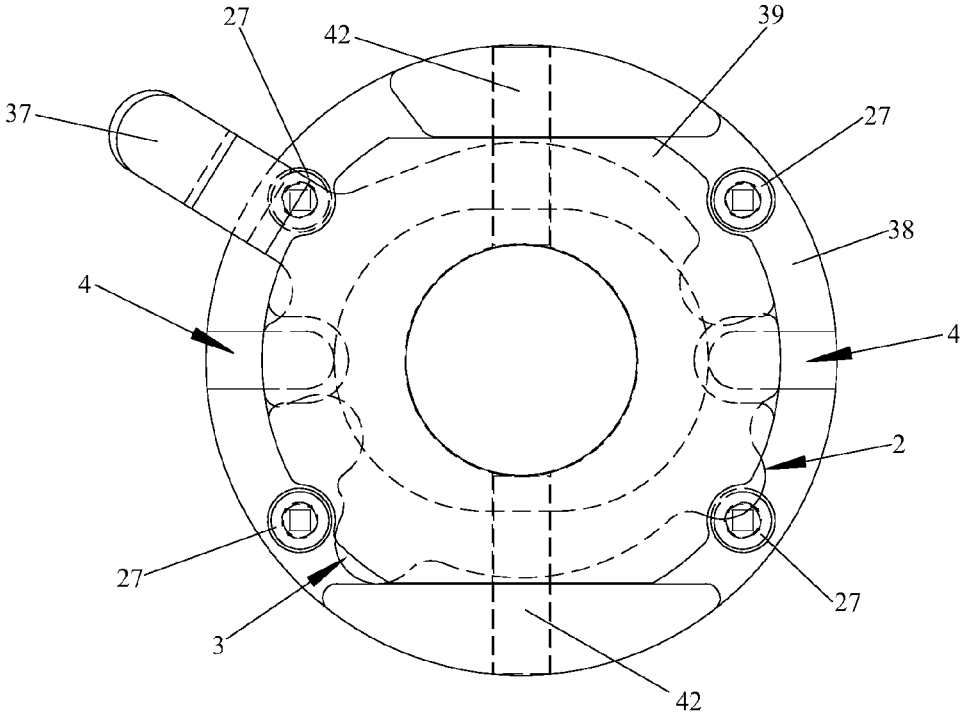
FIG. 17 is a partial front illustrative view of a third embodiment of the present invention showing the swivel mechanism in the locked position.

With reference to FIG. 17, when lock ring 37 is rotated until stop tab 3 contacts the horizontal member of swivel base 38, the openings in lock ring 37 are not aligned with swivel stops 4 on swivel base 38 thus preventing swivel base 38 and moveable front vise jaw 72 from swiveling. Thus moveable front vise jaw 72 is held essentially parallel to fixed rear vise jaw 45 to allow more control when clamping square work. Moveable front vise jaw 72 is not held firmly parallel to fixed rear vise jaw 45 and is allowed a small degree of movement (for example, 1° arc) so that slightly tapered work may be clamped firmly without the need to rotate lock ring 37 to the unlocked free swivel position. It may be apparent to those skilled in the art that swivel stops 4 could be replaced with set screws threaded into holes in swivel base 38 thus allowing adjustment of movement of moveable front vise jaw 72 when lock ring 37 is rotated to prevent swiveling of moveable front vise jaw 72 as described previously.

With reference to FIGS. 13, 14 and 15, clamp shaft 12*b*' passes through a slot in compensator ring 41 and is allowed to freely rotate and translate laterally within the confines of the aforementioned slot. Compensator ring 41 is held in firm contact with clamp hub 36*b*' by spring force from wave spring 21*b*' acting against retaining ring 24*b*' which is housed within a groove in clamp shaft 12*b*'. Two pivot pins 42', coaxially located on either side of clamp shaft 12*b*', pass through holes in compensator ring 41 and compensator base 40. Pivot pins 42' are retained by press fit into appropriately sized holes in compensator ring 41. Once mounted, compensator ring 41 stands proud of the front face of moveable front vise jaw 72 so that when moveable front vise jaw 72 is swiveled an arc limited by contact of swivel ring 39 to swivel base 38 as described previously, clamp hub 36*b*' does not contact the front face of moveable front vise jaw 72. When moveable front vise jaw 72 is swiveled in either direction about pivot pins 42, clamp shaft 12*b*' is allowed to translate within the slot in compensator ring 41 thus allowing for the arc created by moveable front vise jaw 72. The slot in compensator ring 41 also allows for any variation in distance between housings 11*b* and 11*b*' caused by any seasonal wood movement in bench top 46.

Figure 18:
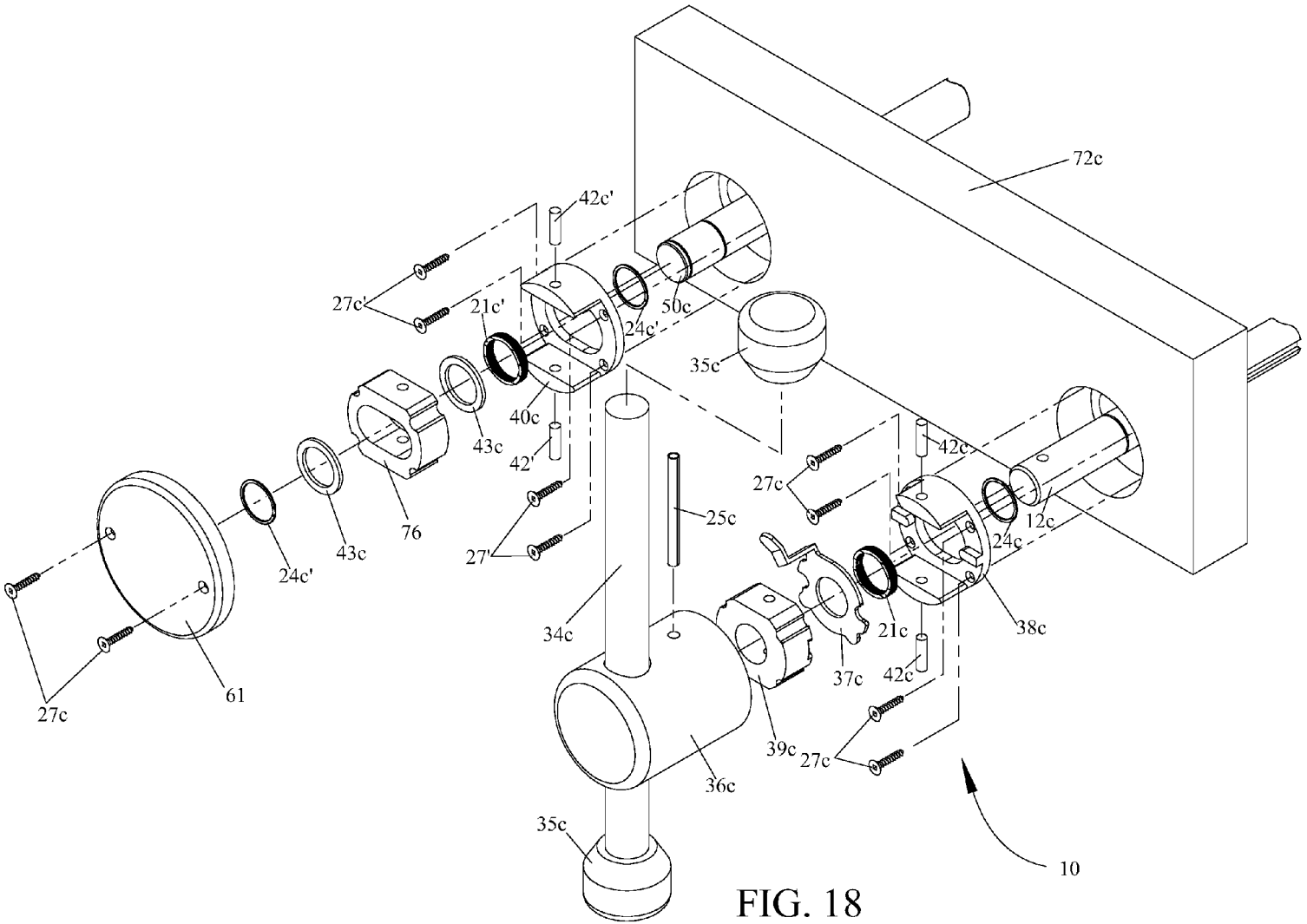
FIG. 18 is a partial perspective exploded view of a fourth embodiment of the vise of the present invention configured as a single handle swivel jaw vise showing the clamp shaft assembly to the clamp hub through the moveable front vise jaw.

The structure of a fourth embodiment shown in FIG. 18 is functionally identical to that of FIGS. 1-10. Reference numerals for functionally identical structure carry suffix "c" in FIG. 18.

In this configuration, moveable front vise jaw 72 is able to swivel identically to the previous embodiment of FIGS. 13-17 and a single clamp handle 34*c*, clamp hub 36*c* and knobs 35*c* is utilized. This configuration may be necessary when the center to center distance of clamp shafts 12*c* and 50*c* are close enough in proximity to interfere with each other and hinder operation of vise 10. All structure associated with clamp shaft 12*c* is identical to structure detailed previously in the previous embodiment of FIGS. 13-17. Since a single handle only is used in this embodiment, clamp shaft 50*c* is constructed without a keyway or a cross hole and has two distally spaced grooves machined into the forward most area of clamp shaft 50*c* as previously described in the second embodiment of FIGS. 11-12. Clamp shaft 50*c* passes through a clearance hole in moveable front vise jaw 72*c* and through compensator base 40*c*, wave spring 21*c*', washer 43*c*' and single handle compensator ring 76. The rear most groove of clamp shaft 50*c* accepts retaining ring 24*c*'. Wave spring 21*c*' bears against retaining ring 24*c*' and applies spring pressure through washer 43*c*' and against the rear face of single handle compensator ring 76. Clamp shaft 50*c* protrudes slightly through single handle compensator ring 76 and is retained with retaining ring 24*c*' installed in the forward most groove machined in clamp shaft 50*c*, bearing against washer 43*c*'. Compensator base 40*c* is rigidly mounted within a circular pocket in moveable front vise jaw 72*c* using wood screws 27*c*'. When mounted, compensator base 40*c* is slightly lower than the outer surface of moveable front vise jaw 72*c*.

Clamp shaft 50*c*' passes through a slot in single handle compensator ring 76 and is allowed to freely rotate and translate laterally within the confines of the aforementioned slot. Single handle compensator ring 76 is held in firm contact with washer 43*c*' by spring force from wave spring 21*c*' acting against front retaining ring 24*c*' which is housed within a groove in clamp shaft 50*c*. Two pivot pins 42*c*', coaxially located on either side of clamp shaft 12*c*', pass through holes compensator base 40*c* and into holes in single handle compensator ring 76. Pivot pins 42*c*' are retained by a press fit into the appropriately sized holes in single handle compensator ring 76. Once mounted, single handle compensator ring 76 remains within the front face of moveable front vise jaw 72 whether swiveled fully or not, so that the entire assembly may be concealed by decorative cover plate 61 mounted to moveable front vise jaw 72*c* with wood screws 27*c*. When moveable front vise jaw 72*c* is swiveled in either direction about pivot pins 42*c*', clamp shaft 50*c* is allowed to translate within the slot in single handle compensator ring 76 thus allowing for the arc created by moveable front vise jaw 72*c*. The slot in single handle compensator ring 76 also allows for any variation in distance between housings 11*c* and 11*c*' (not shown) caused by any seasonal wood movement in bench top 46.

The structure of a fifth embodiment shown in FIGS. 19-22 is functionally identical to that of FIGS. 1-10. Reference numerals for functionally identical structure carry suffix "d" in FIGS. 19-22.

In this configuration, vise 10 is constructed as a leg vise where clamping of the workpiece is done above clamp shaft 12*d*. In a typical leg vise the lower fulcrum arm is held immobile by a pin inserted in a hole in the fulcrum arm and pressed against the workbench leg while the upper vise screw is tightened causing the upper portion of the vise jaw to secure the workpiece. In this arrangement vise 10 is mounted vertically as show in FIG. 19 and the lower housing 11*d*' is rotated 180° relative to the upper housing 11*d*. In this way, the upper clamp shaft 12*d* will pull moveable leg vise jaw 53 inward toward workbench leg 58 while clamp shaft 50*d* will push moveable leg vise jaw 53 outward from workbench leg 58 when handle 34*d* is rotated, thus creating a net inward force applied above clamp shaft 12*d* to effect clamping.

Figure 19:
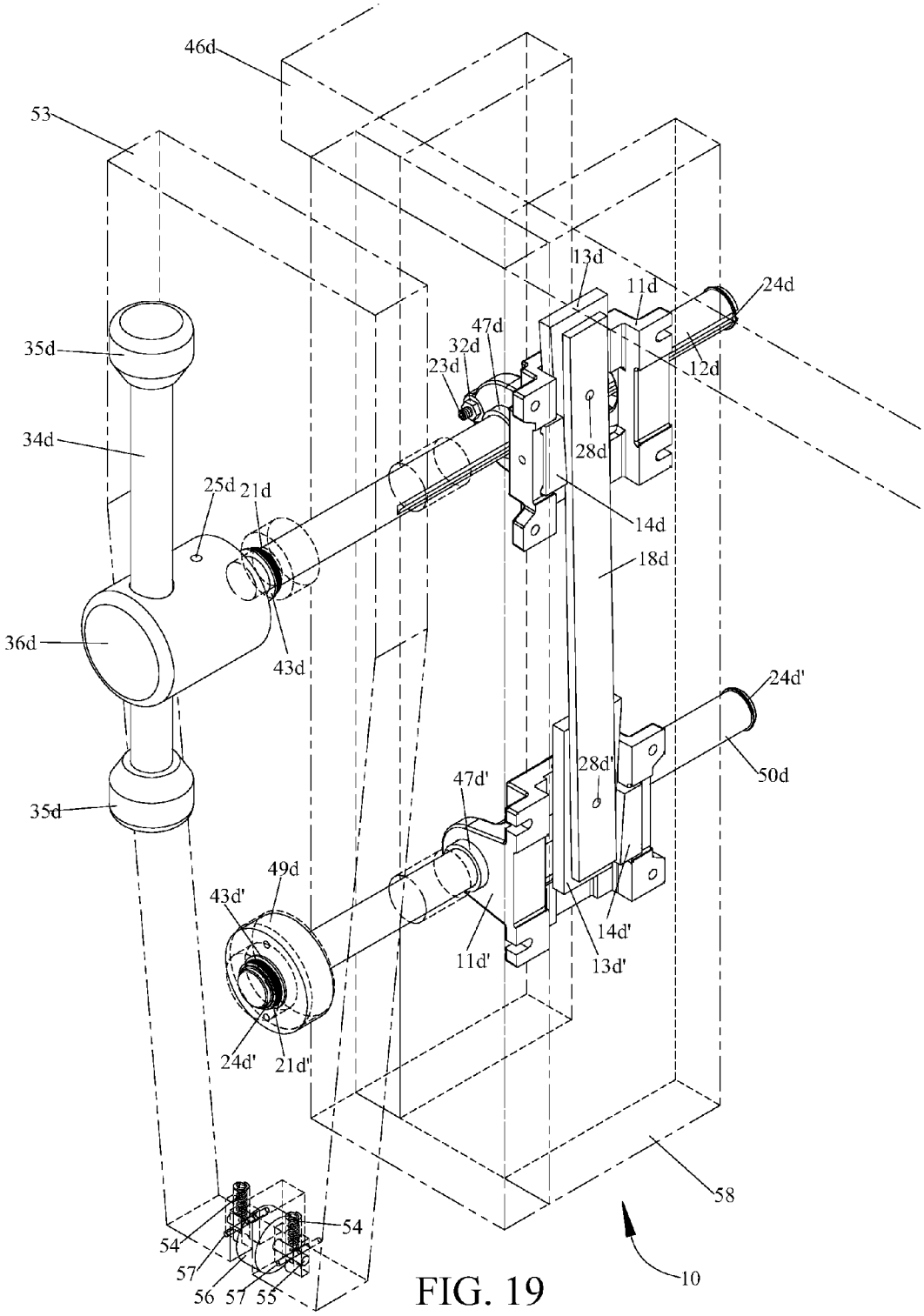
FIG. 19 is a perspective view of a fifth embodiment of the vise of the present invention configured as a leg vise with the moveable front vise jaw, bench leg and partial bench top shown in phantom for clarity.

With respect to FIG. 19 the elements contained in housings 11*d* and 11*d*' are identical to the elements previously described in FIG. 12 for a single handle vise with the only difference being that housing 11*d*' is rotated 180° relative to housing 12*d*. Both housings 11*d* and 11*d*' are firmly mounted to the inside face of bench leg 58 with bolts, screws or other suitable fasteners (not shown). Workbench leg 58 is constructed of suitably sized wood securely fastened together in the form of a "U" section to provide needed stiffness and to conceal housings 11*d* and 11*d*' for aesthetic reasons. Transfer bar 18*d* and elements contained within housings 11*d* and 11*d*' are contained on one side by the rightmost inner side of workbench leg 58 in a similar fashion as previously described in the configuration of FIGS. 1-10. The upper clamp shaft 12*d* protrudes through a clearance hole in the front member of workbench leg 58 and lower clamp shaft 50*d* also protrudes through a clearance hole in the front member of workbench leg 58.

Figure 20:
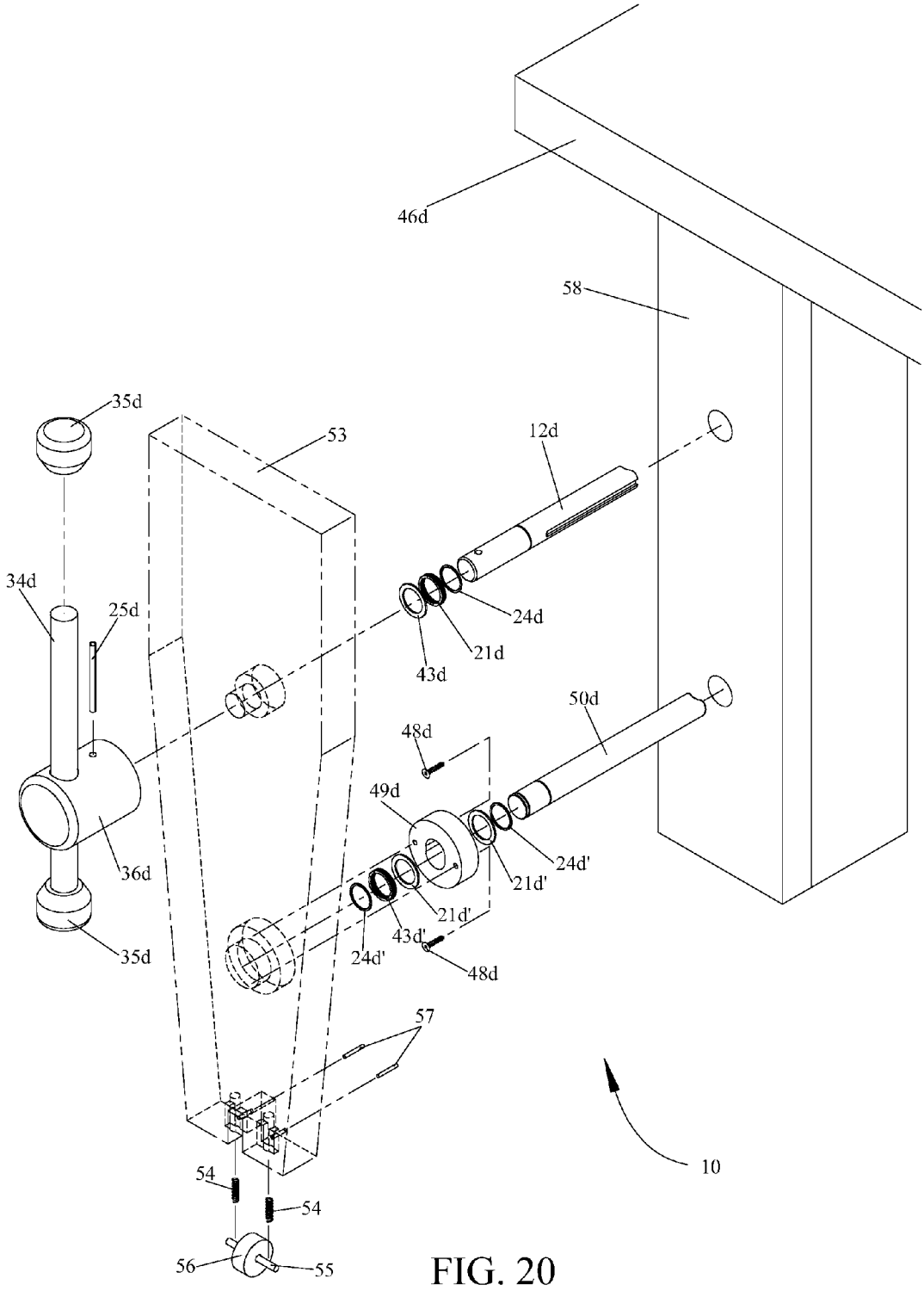
FIG. 20 is a partial perspective exploded view of a fifth embodiment of the vise of the present invention showing the clamp shaft assembly to the clamp hub through the moveable front leg vise jaw shown in phantom for clarity.

With reference to FIG. 20 upper clamp shaft 12*d* passes through moveable leg vise jaw 53 and is secured to clamp hub 36*d* with split pin 25*d* installed through cross hole in clamp hub 36*d* and upper clamp shaft 12*d*. Clamp hub 36*d*, handle 34*d*, knobs 35*d*, washer 43*d*, wave spring 21*d* and retainer 24*d* function identically to the first embodiment previously described in FIG. 3. Lower clamp shaft 50*d* passes through compliance ring 49*d*, washer 21*d* and wave spring 43*d* with retaining ring 24*d*' installed in the forward most groove machined in lower clamp shaft 50*d* to retain compliance ring 49*d* from coming off the end of lower clamp shaft 50*d*. Compliance ring 49*d* is retained on the other side by washer 21*d*' and retaining ring 24*d*' installed in a second groove slightly rearward of the forward most groove. Compliance ring 49*d* is securely installed, with the slot oriented vertically, in a circular pocket machined in moveable leg vise jaw 53 with wood screws 48*d*. The use of compliance ring 49*d* allows for easy assembly and preserves the appearance of the front face of moveable leg vise jaw 53 since all mounting hardware is hidden on the rear side of moveable leg vise jaw 53. Compliance ring 49*d* also provides compliance to moveable leg vise jaw 53 in an identical fashion to the first embodiment described in FIGS. 1-10. Contained in a pocket and very near the floor, in the lower most portion of moveable leg vise jaw 53 is a wheel 56 mounted on axle 55. Springs 54 mounted in holes on both sides of wheel 56 apply downward pressure on axle 55 which is retained from falling out of moveable leg vise jaw 53 by split pins 57 installed in holes under axle 55. Spring pressure from springs 54 push against axle 55 and thus cause wheel 56 to apply pressure against the floor which counteracts the weight of moveable leg vise jaw 53 so moveable leg vise jaw 53 is easy to move in and out when in the unclamped state.

Figure 22:
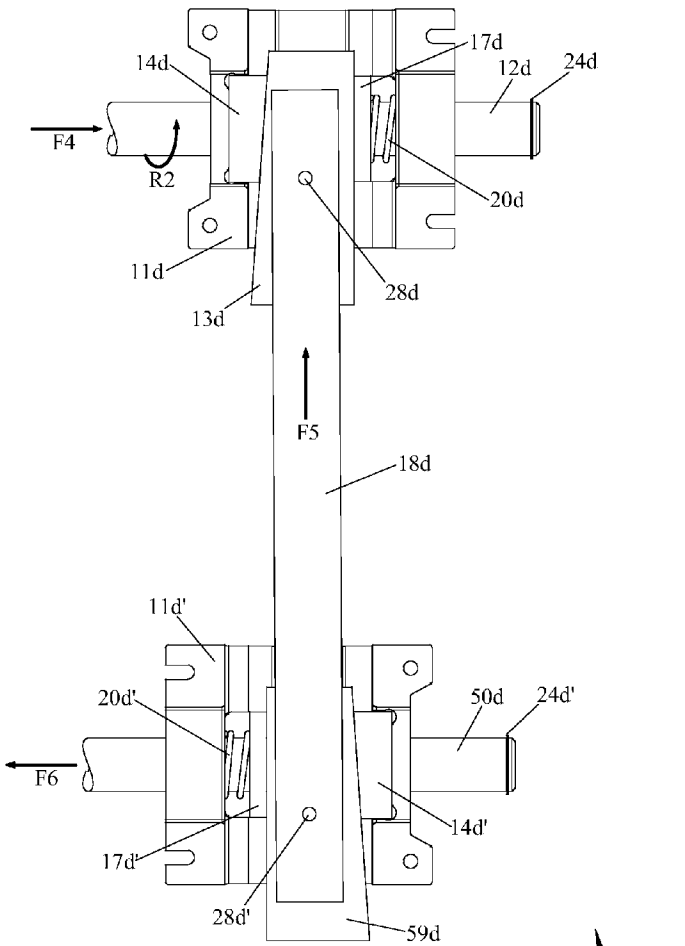
FIG. 22 is a partial right side view showing a fifth embodiment of the vise of the present invention in the unclamped state and configured for clamping by counter-clockwise rotation of the clamp handle.
Figure 21:
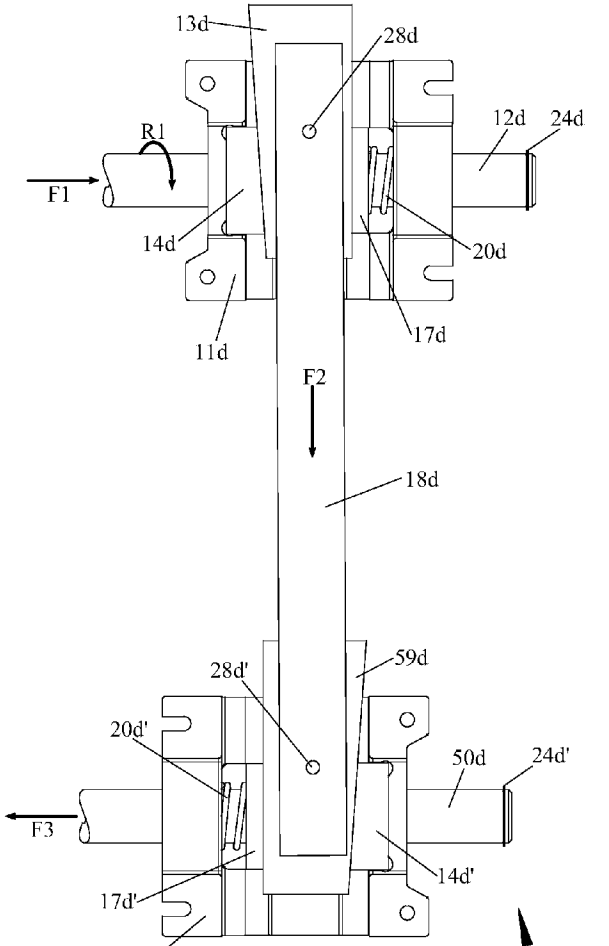
FIG. 21 is a partial right side view showing a fifth embodiment of the vise of the present invention in the unclamped state and configured for clamping by clockwise rotation of the clamp handle.
Figure 23:
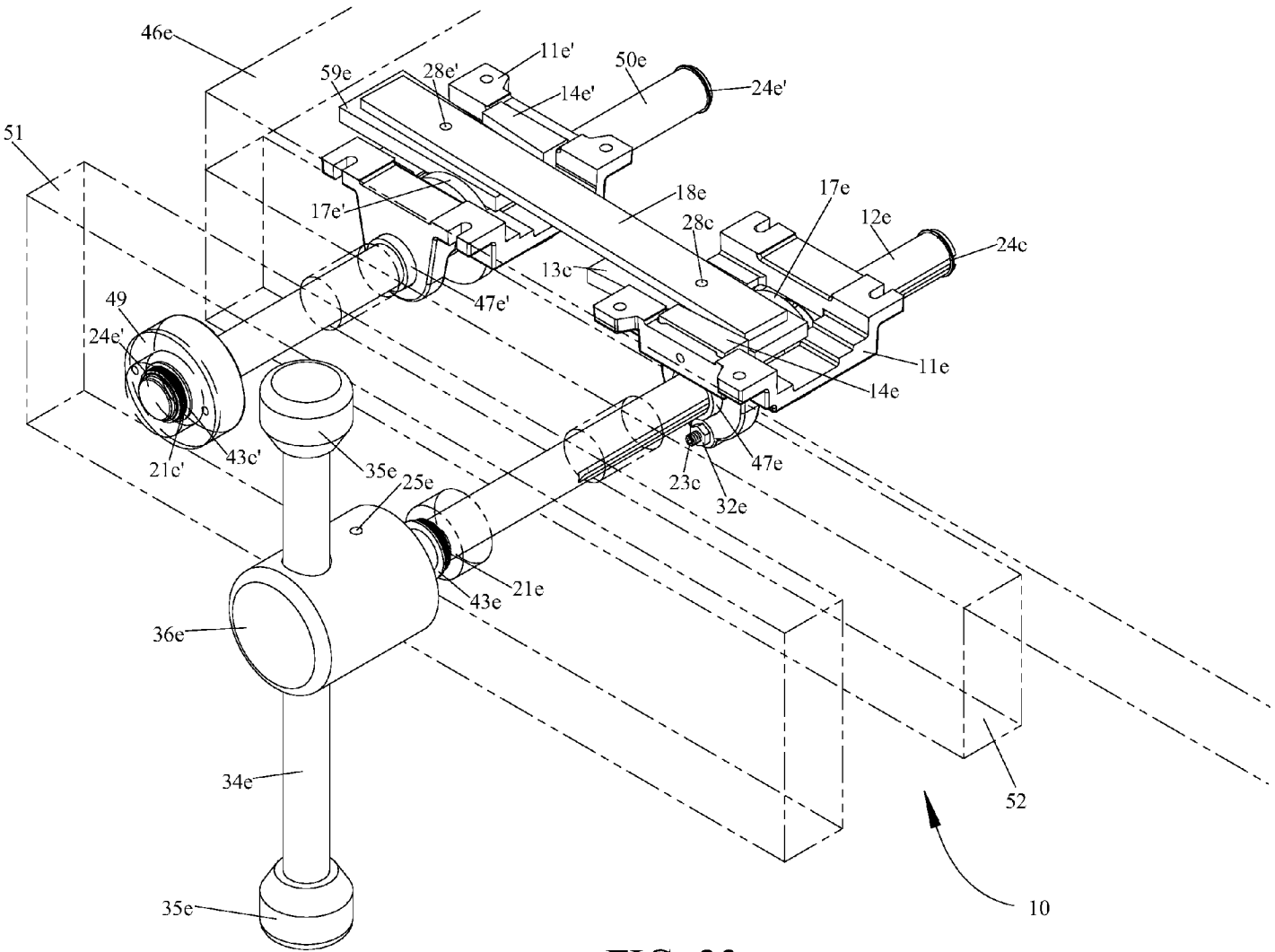
FIG. 23 is a perspective view showing a sixth embodiment of the vise of the present invention configured as a shoulder vise with the moveable front shoulder vise jaw, fixed rear vise jaw and partial bench top shown in phantom for clarity.
Figure 24:
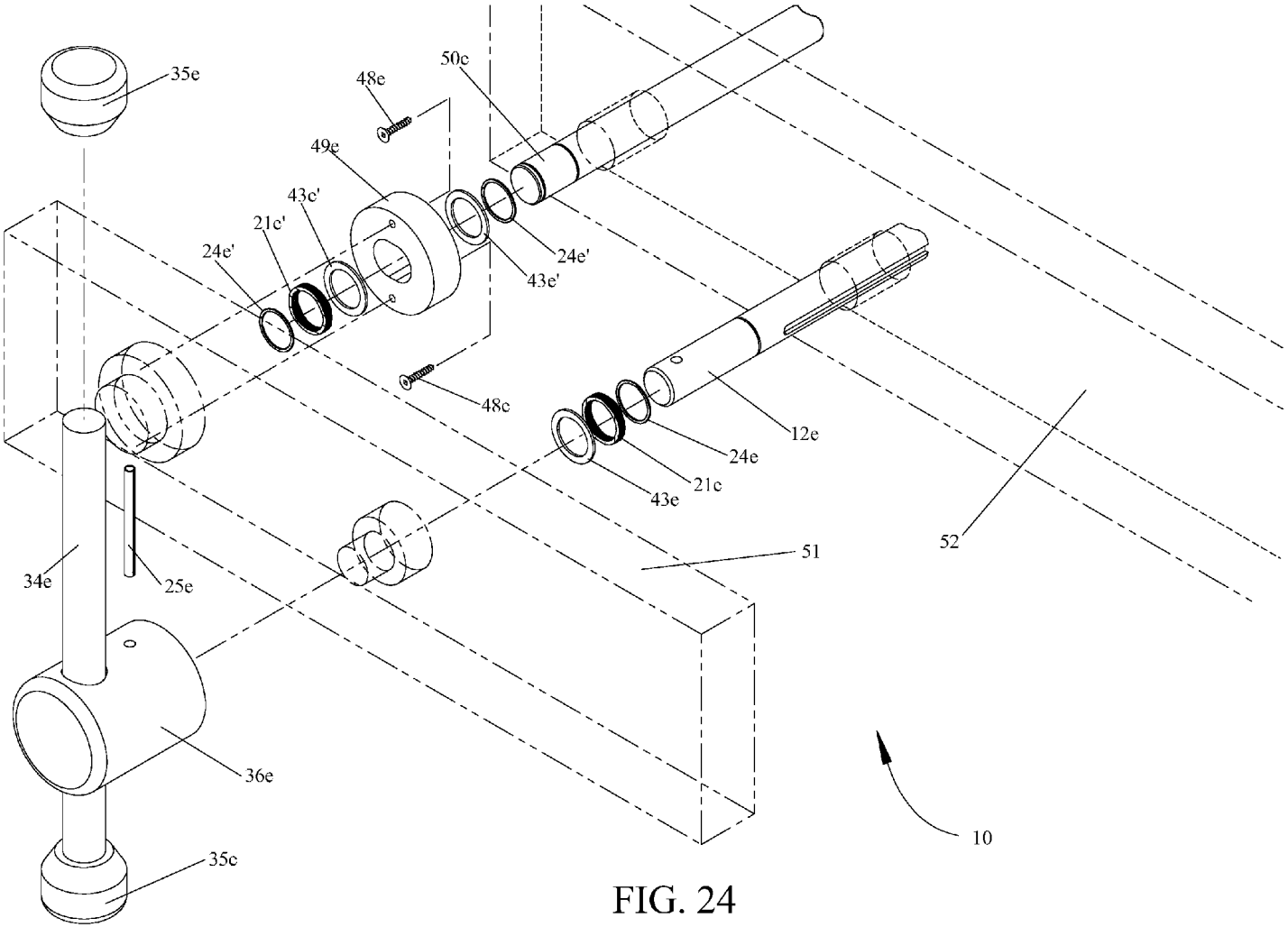
FIG. 24 is a partial perspective exploded view of a sixth embodiment of the vise of the present invention showing the clamp shaft assembly to the clamp hub through the moveable front shoulder vise jaw and rear fixed vise jaw shown in phantom for clarity.

As mentioned above, vise 10 can be configured to clamp with clockwise rotation of clamp handle 34*d* or with counter-clockwise rotation of clamp handle 34*d*. When bridges 13*d* and 59*d* and wedges 14*d* and 14*d*' are oriented as shown in FIG. 21, CW rotation R1 of clamp shaft 12*d* enables clamping force F1 to pull upper clamp shaft 12*d* in toward workbench leg 58, creating translational force F2 to be applied through transfer bar 18*d* which creates fulcrum arm force F3 to push lower clamp shaft 50*d* away from workbench leg 58. Transfer bar 18*d* rotates slightly about pins 28*d* and 28*d*' since the movements of clamp shafts 12*d* and 50*d* are 180° out of phase. To configure vise 10 to clamp with CCW rotation of clamp handle 34*d*, bridges 13*d* and 59*d* and wedges 14*d* and 14*d*' are simply removed from housings 11*d* and 11*d*' rotated 180° about a longitudinal axis and re-installed into housings 11*d* and 11*d*' as depicted in FIG. 22. Counter-clockwise rotation R2 of clamp shaft 12*d* enables clamping force F4 to pull upper clamp shaft 12*d* in toward workbench leg 58, creating translational force F5 to be applied through transfer bar 18*d* which creates fulcrum arm force F6 to push lower clamp shaft 50*d* away from workbench leg 58. Transfer bar 18*d* rotates slightly about pins 28*d* and 28*d*' since the movements of clamp shafts 12*d* and 50*d* are 180° out of phase.

The structure of a sixth embodiment shown in FIGS. 23-26 is functionally identical to that of FIGS. 1-10. Reference numerals for functionally identical structure carry suffix "e" in FIGS. 23-26.

In this arrangement, vise 10 is constructed as an adaptation of a Scandinavian shoulder vise where clamping of the workpiece is done to the right of clamp shaft 12*e*. In a typical Scandinavian shoulder vise the vise screw is held in a cantilevered arm mounted to a vise block which is firmly attached to the workbench top. In this arrangement vise 10 is mounted horizontally under bench top 46*e* as show in FIGS. 23 and 24 and the left most housing 11*e*' is rotated 180° relative to the right most housing 11*e*. In this way, the right most clamp shaft 12*e* will pull moveable shoulder vise jaw 51 inward toward fixed rear shoulder vise jaw 52 while left most clamp shaft 50*e* will push moveable shoulder vise jaw 51 outward from rear fixed shoulder vise jaw 52 when handle 34*e* is rotated, thus creating a net inward force applied to the right of clamp shaft 12*e* to effect clamping. The operation and function of this configuration is identical to that of the arrangement of FIGS. 19-20 except vise 10 is mounted horizontally under workbench top 46*e*, clamp shafts 12*e* and 50*e* protrude through clearance holes in rear fixed shoulder vise jaw 52 and the workpiece is clamped to the right of right clamp shaft 12*e*. It will be apparent to those skilled in the art that vise 10 may also be mounted to the right end of workbench top 46*e* with clamp shaft 12*e* to the left of clamp shaft 50*e* and the workpiece clamped to the left of clamp shaft 12*e*.

Figure 25:
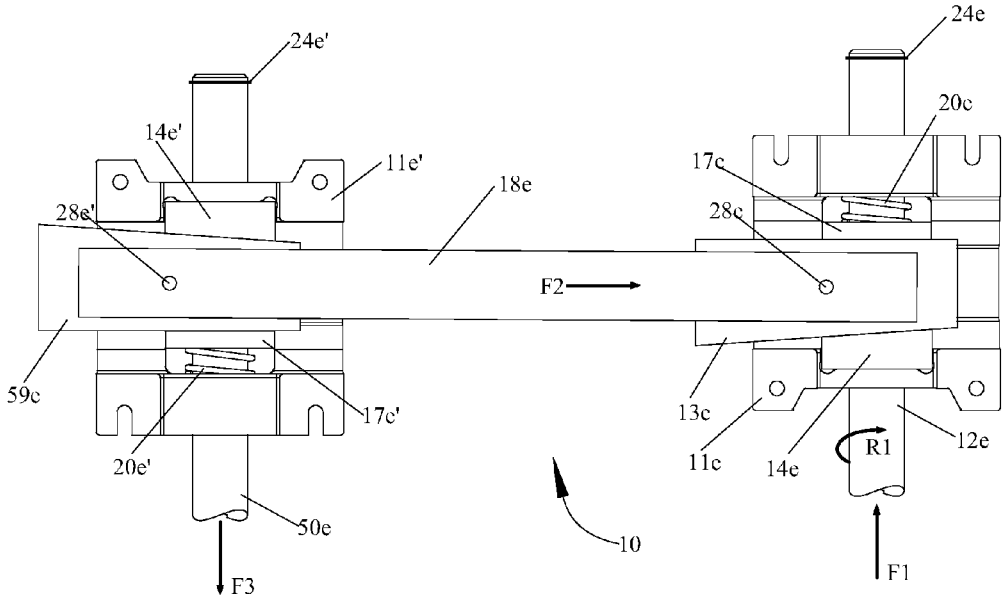
FIG. 25 is a partial top plan view showing a sixth embodiment of the vise of the present invention in the unclamped state and configured for clamping by clockwise rotation of the clamp handle.
Figure 26:
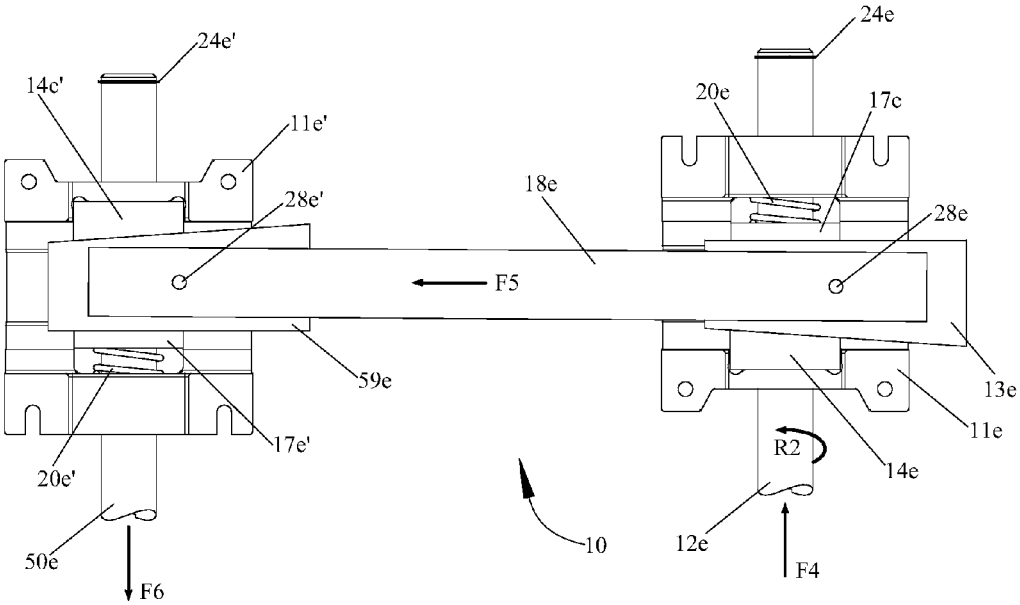
FIG. 26 is a partial top plan view showing a sixth embodiment of the vise of the present invention in the unclamped state and configured for clamping by counter-clockwise rotation of the clamp handle.

As in previous embodiments, the vise 10 can be configured to clamp with CW rotation of clamp handle 34*e* or with CCW rotation of clamp handle 34*e*. When bridges 13*e* and 59*e* and wedges 14*e* and 14*e*' are oriented as shown in FIG. 25, CW rotation R1 of clamp shaft 12*e* enables clamping force F1 to pull right most clamp shaft 12*e* in toward rear fixed shoulder vise jaw 52, creating translational force F2 to be applied through transfer bar 18*e* which creates fulcrum arm force F3 to push left most clamp shaft 50*e* away from fixed rear shoulder vise jaw 52. Transfer bar 18*e* rotates slightly about pins 28*e* and 28*e*' since the movements of clamp shafts 12*e* and 50*e* are 180° out of phase. To configure vise 10 to clamp with CCW rotation of clamp handles 34*e*, bridges 13*e* and 59*e* and wedges 14*e* and 14*e*' are simply removed from housings 11*e* and 11*e*' rotated 180° about a longitudinal axis and re-installed into housings 11*e* and 11*e*' as depicted in FIG. 22. Counter-clockwise rotation R2 of clamp shaft 12*e* enables clamping force F4 to pull right most clamp shaft 12*e* in toward rear fixed shoulder vise jaw 52, creating translational force F5 to be applied through transfer bar 18*e* which creates fulcrum arm force F6 to push left most clamp shaft 50*e* away from fixed rear shoulder vise jaw 52. Transfer bar 18*e* rotates slightly about pins 28*e* and 28*e*' since the movements of clamp shafts 12*e* and 50*e* are 180° out of phase. In an alternative implementation of this sixth embodiment, not shown in the drawings, the counter-acting movement of the first and second clamping sub-assemblies that work to angularly displace the jaws 51, 52 could be employed in a portable hand-screw clamp type of device with similar effectiveness.

The structure of a seventh embodiment shown in FIGS. 27-29 is functionally identical to that of FIGS. 1-10. Reference numerals for functionally identical structure carry suffix "f" in FIGS. 27-29.

In this configuration, vise 10 is constructed in a shingle-shaft design as an adaptation of a tail vise where clamping of the workpiece is done on top of workbench top 74 between jaws in the form of a workbench dog 69 and moveable tail vise dog 64 as shown in FIG. 27. Tail vise dog 64 slides on a dovetail machined into dog block 63 allowing tail vise dog 64 to slide up and down to accommodate different thicknesses of work and can be fully retracted below the surface of workbench top 74 when not in use. Tail vise dog 64 and dog block 63 are located within a narrow slot machined through workbench top 74. Workbench dog 69 may be installed in spaced holes to accept varying lengths of work clamped between workbench dog 69 and tail vise dog 64. Movement of dog block 63 and tail vise dog 64 to effect clamping is accomplished by rotating handle 34*f* with associated knobs 35*f* which causes rotation of clamp hub 36*f* which is located outside of tail vise apron 70 which is firmly affixed to workbench top 74.

With respect to FIGS. 28 and 29, clamp shaft 12*f* is held at one end by a close fit clearance hole in pillow block bearing 67 which is securely mounted to the underside of workbench top 74 with screws or other appropriate fasteners (not shown). The other end of clamp shaft 12*f* is contained within a close fitting clearance hole bored into tail vise apron 70. Clamp shaft 12*f* is thus allowed to freely rotate within the confines of the close fitting clearance holes in pillow block bearing 67 and tail vise apron 70. Clamp shaft 12*f* is prevented from sliding laterally to the left by clamp hub 36*f* which is secured to clamp shaft 12*f* by split pin 25*f* installed in cross holes machined in the end of clamp shaft 12*f*. Clamp shaft 12*f* is prevented from sliding laterally to the right by shaft collar 68 which is firmly clamped to clamp shaft 12*f* and is located on the inboard side of tail vise apron 70 with a slight clearance to allow suitable retention while allowing free rotation.

Plate 62 is mounted to housing 11*f* by flat head machine screws 65 and nuts 66 installed in mounting holes and slots on housing 11*f*. Dog block 63 is fastened to the top side of plate 62 using flat head machine screws 65 installed in tapped holes in the bottom of dog block 63. Plate 62 retains the elements found within housing 11*f* and transfers motion to dog block 63. Housing 11*f* is free to translate along shaft 12*f* when in the unclamped state thus allowing tail vise dog 64 to be quickly positioned against the workpiece to be secured. Plate 62 is located with a small amount of clearance from the underside of workbench top 74 so housing 1 if is free to move laterally while being restrained from rotation about clamp shaft 12*f* by the protrusion of dog block 63 into the slot machined through workbench top 74. Dog block 63 is kept slightly below the top surface of workbench top 74 and has a dovetail machined at a slight forward angle on one side (2 to 4 degrees for example). A corresponding dovetail machined into tail vise dog 64 allows tail vise dog 64 to slide freely on dog block 63 with spring force from spring plunger 71 installed in threaded hole in dog block 63 providing frictional retaining force so tail vise dog 64 remains at any height setting the operator desires. The slight forward angle of dog block 63 similarly angles tail vise dog 64 so that a component of clamping force is directed downward toward the workbench top 74 thus keeping the workpiece to be clamped in firm contact with workbench top 74.

The structure located within housing 11*f* function in a similar manner to the first embodiment of FIGS. 1-10. Tail vise transfer bar 73 does not connect to any other elements and is only long enough to cover the rectangular hole in bridge 13*f*. Transfer bar 73 is kept from rotating about pin 28*f* by use of liquid retaining compound commonly used for retention purposes or alternatively pin 28*f* could also be press fit into suitable holes in transfer bar 73 and rack 15*f*.

Clamping of a workpiece is accomplished as follows: Tail vise dog 64 is adjusted vertically to accommodate the thickness of the workpiece to be clamped and one side of the workpiece is placed against bench dog 69. With the vise in the unclamped state tail vise dog 64 is slid within the slot in workbench top 74 until it contacts the workpiece on the opposite side from bench dog 69. Counter-clockwise rotation of handle 34*f* causes similar rotation in clamp shaft 12*f* which creates relative motion between shaft 12*f* and housing 11*f* as previously described in the first embodiment of FIGS. 1-10. Since clamp shaft 12*f* is retained from moving laterally as previously described, housing 11*f*, plate 62, dog block 63 and tail vise dog 64 translate toward bench dog 69 thus clamping workpiece between bench dog 69 and tail vise dog 64. Clamping can be accomplished with CW rotation of handle 34*f* by simply removing bridge 14*f* and wedge 13*f* from housing 11*f* and rotating 180° about a longitudinal axis and re-installing into housing 11*f* as described in the first embodiment of FIGS. 1-10.

It will be understood that each of the elements described above, or two or more together, may also find a useful application in other types of structures differing from the types described above.

The present invention improves prior art vises by providing a vise mechanism which is very versatile and can be configured into any of the vise forms previously described. Additionally the vise of the present invention has quick release that occurs automatically when unclamped and utilizes clamp shafts which can be designed so as not to require any lubrication for operation. The twin clamp shafts of certain embodiments allow work to be clamped anywhere in the vise jaws without racking and the vise may be simply configured to clamp with CW or CCW rotation of the clamp handle to suit the operator. It may be constructed to appear as a traditional 18th century twin screw vise with wooden vise jaws, handles and clamp hubs or as a traditional leg vise with a single wooden vise handle and wooden jaw. It may also be configured into a quick action shoulder style vise having a certain aesthetic appeal and streamlined appearance utilizing a single wooden handle and clamp hub. The invention may also be designed as a single shaft vise in a variety of configurations including but not limited to a tail vise like that shown in FIGS. 27-29. Alternatively still, the scaled version of the vise may be liberated from a stationary bench application and used in a portable hand clamping application, such as to replicate a traditional hand screw clamps using the arrangement principles of the design shown in FIG. 23.

The present invention vise operates smoothly and precisely without sagging or screw "chatter" common on quick action screw operated vises. It is simple and easy to install and adjust and clamping force can be limited for delicate work. The vise may be configured in any width desired and utilize one or two clamping handles. The vise jaw may be designed to allow a small amount of skew (approximately 2 degrees in either direction for example) which accommodates slightly out of square work to be clamped. The front vise jaw may be configured to allow it to swivel considerably (up to 10 degrees in either direction for example) for tapered or irregular objects to be firmly clamped. The vise may also be configured, using a single clamp shaft, into an enclosed tail vise with quick action and simple installation. The tail vise is visually appealing with a very narrow slot in the bench top and a wooden clamp hub and handle.

In accordance with the teachings of the present invention, a vise is provided which includes a pair of spaced housings secured to the underside of the workbench top. A pair of parallel clamp shafts is received in holes in the respective housings and is free to slide in and out of the housings. The clamp shafts pass through holes in the laterally-extending rear vise jaw which is secured to the workbench top. The clamp shafts further pass through holes in the movable front vise jaw and are fixed to clamp hubs which transfer motion from the clamp handles into the clamp shafts. Means may be provided to allow the front vise jaw to swivel and allow tapered objects to be clamped.

Pinions, which freely slide on the clamp shafts, are contained within the housings and convert rotational movement from the clamp shafts into linear movement by means of a corresponding rack. The linear motion actuates a bridge which slides against a laterally fixed wedge causing the bridge to displace a locking element which clutches and moves the clamp shafts to affect clamping. The linear motion from one clamp shaft is transferred through a rack and pinion to the other clamp shaft through a transfer bar and to the corresponding rack and pinion in the other housing. In this way, either clamp handle can be used to actuate the vise and both clamp shafts operate in unison when clamping. The vise may also be configured to utilize only one clamp hub and handle if desired, or more that two clamp shafts.

Adjustment screws located in each housing allow the clamping action of each clamp shaft to be quickly and easily synchronized. The wedge and bridge pair can be reversed to allow clamping to occur with a clockwise rotation of the clamp handle or a counter-clockwise rotation of the clamp handle. In alternative embodiments, the wedge and bridge pair can be re-oriented to cause the jaws to spread apart rather than draw together. When the clamp handle is in the unclamped position, the clamp shafts are free to move in and out of the housing, independent from one another, thus allowing the front vise jaw to be quickly positioned against the workpiece, whether straight or tapered, with one hand while the other hand is free to actuate the clamp handle and secure the workpiece.

In twin shaft applications, one of the housings may be rotated 180° relative to the other to provide outward clamping force on one clamp shaft and inward clamping force on the other clamp shaft to allow clamping of a workpiece outside of (i.e., not in-between) the two clamp shafts. This allows the vise to be utilized as a leg or shoulder vise.

While the invention has been illustrated and described as embodied in woodworking settings, it is not intended to be limited to the details shown or exemplary applications mentioned, since various modifications and structural changes may be made without departing in any way from the spirit of the present invention.

What is claimed is:

1. A screw-less vise assembly of the type for clamping a workpiece between opposing jaws, said assembly comprising:

a housing;

a pair of jaws; at least one of said jaws being moveable relative to the other said jaw;

an elongated clamp shaft defining a long axis; said clamp shaft slideably disposed relative to said housing;

a locking element retained by said housing; said locking element having a central hole through which said clamp shaft slideably extends;

a wedge supported relative to said housing; and a bridge operatively disposed between said wedge and said locking element for reciprocating linear movement in response to rotation of said clamp shaft; said bridge configured to angularly displace said locking element into canted frictional engagement with said clamp shaft and then, with continued rotation of said clamp shaft, to axially displace said clamp shaft relative to said housing thereby forcibly drawing said moveable jaw toward the other said jaw or spreading said moveable jaw away from the other said jaw.

2. The assembly of claim 1, wherein said locking element is rotatable relative to said clamp shaft.

3. The assembly of claim 2, wherein clamp shaft is generally cylindrical and said central hole is generally circular.

4. The assembly of claim 3, said locking element is generally annular with a generally circular outer periphery.

5. The assembly of claim 1, further including a biasing member continuously urging said body of said locking element toward a generally perpendicular orientation relative to said axis of said clamp shaft.

6. The assembly of claim 1, wherein said bridge has a skewed working edge and a straight working edge; said skewed working edge interactive with said bridge; said straight working edge interactive with said locking element.

7. The assembly of claim 6, further including a pinion gear disposed in said housing and carried on said clamp shaft; said pinion gear axially slidable along said clamp shaft; and a rack gear disposed in said housing; said rack operatively meshing with said pinion and supported for reciprocating linear movement as a unit with said bridge.

8. The assembly of claim 7, wherein said bridge is selectively invertible relative to said rack.

9. The assembly of claim 1, wherein said wedge is generally linear.

10. The assembly of claim 1, wherein said wedge fixed relative to said housing.

11. The assembly of claim 1, wherein said biasing member includes a helical compression spring surrounding said clamp shaft.

12. The assembly of claim 1, wherein said clamp shaft includes a longitudinally extending keyway.

13. The assembly of claim 1, further including a second housing; a second clamp shaft disposed parallel to said axis of said clamp shaft; a second locking element supported by said second housing; a second wedge supported relative to said second housing; a second bridge operatively disposed between said second wedge and said second locking element for reciprocating linear movement; and a motion transmitting member interconnecting said bridge and said second bridge for simultaneously displacing said bridge and said second bridge in response to rotation of said clamp shaft.

14. The assembly of claim 13, wherein said motion transmitting member comprises a rigid transfer bar.

15. The assembly of claim 14, wherein said second bridge is operatively associated with a second rack gear disposed in said second housing; and wherein said rigid transfer bar operatively and directly engages each said rack gear and said second rack gear to transmit motion therebetween.

16. A method for clamping a workpiece between opposable jaws in a screw-less vise assembly, said method comprising the steps of:

providing a pair of jaws; at least one of the jaws being moveable relative to the other the jaw;

slideably and rotatably supporting an elongated clamp shaft along its long axis through the moveable jaw;

slideably supporting a locking element on the clamp shaft;

providing a wedge; and locating a bridge between the wedge and the locking element;

slideably supporting the bridge for reciprocating linear movement;

angularly displacing the locking element into canted frictional engagement with the clamp shaft in direct response to rotation of the clamp shaft; and said angularly displacing step further including axially displacing the clamp shaft relative to the housing with continued rotation of the clamp shaft thereby forcibly moving the moveable jaw toward or away from the other jaw.

17. The method of claim 16, further including the step of rotating the locking element relative to the clamp shaft.

* * * * *